US010151164B2

(12) United States Patent
Bennett et al.

(10) Patent No.: US 10,151,164 B2
(45) Date of Patent: Dec. 11, 2018

(54) SINGLE-TRIP CASING CUTTING AND BRIDGE PLUG SETTING

(71) Applicant: Schlumberger Technology Corporation, Sugar Land, TX (US)

(72) Inventors: Adam M. Bennett, Spring, TX (US); Stephen J. Hekelaar, Spring, TX (US); Ryan F. Strachan, Aberdeen (GB); David A. Stokes, The Woodlands, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 169 days.

(21) Appl. No.: 14/673,081

(22) Filed: Mar. 30, 2015

(65) Prior Publication Data

US 2015/0275605 A1 Oct. 1, 2015

Related U.S. Application Data

(60) Provisional application No. 61/972,573, filed on Mar. 31, 2014, provisional application No. 62/055,740, filed on Sep. 26, 2014.

(51) Int. Cl.

| | |
|---|---|
| ***E21B 29/00*** | (2006.01) |
| ***E21B 33/134*** | (2006.01) |
| ***E21B 10/32*** | (2006.01) |

(52) U.S. Cl.

CPC ..... *E21B 29/002* (2013.01); *E21B 10/32* (2013.01); *E21B 33/134* (2013.01)

(58) Field of Classification Search

CPC ..... E21B 29/002; E21B 10/32; E21B 33/134

See application file for complete search history.

(56) References Cited

U.S. PATENT DOCUMENTS

| | | | |
|---|---|---|---|
| 4,765,404 | A | 8/1988 | Bailey et al. |
| 5,584,350 | A | 12/1996 | Schnitker et al. |
| 6,050,334 | A | 4/2000 | McGarian et al. |

(Continued)

FOREIGN PATENT DOCUMENTS

| | | | |
|---|---|---|---|
| WO | 2014027178 | A2 | 2/2014 |

OTHER PUBLICATIONS

International Search Report for corresponding International App No. PCT/US2015/023662, dated Jul. 16, 2015, 4 pages.

(Continued)

*Primary Examiner* — Brad Harcourt

(57) ABSTRACT

A downhole tool may include a bridge plug releasably coupled to a casing cutting tool. The bridge plug may be set within a wellbore and the casing cutting tool may be used in a milling or perforating operation during a single downhole trip of the downhole tool. A method for using a downhole tool may include setting the bridge plug in a wellbore and performing a casing cutting operation during a same downhole trip. The casing cutting tool may be a section mill and a section milling operation may be performed before or after uncoupling the bridge plug from the section mill while downhole. The section milling operation may remove an entire portion of casing within a region of the wellbore for receiving a cement plug. The casing cutting too may be a perforation tool and perforating may be used to remove portions of casing.

20 Claims, 14 Drawing Sheets

(56) References Cited

U.S. PATENT DOCUMENTS

| | | | | |
|---|---|---|---|---|
| 6,202,761 | B1 * | 3/2001 | Forney | E21B 7/061 175/61 |
| 8,469,096 | B2 | 6/2013 | McGarian et al. | |
| 8,763,696 | B2 | 7/2014 | Bedouet et al. | |
| 2007/0034409 | A1 | 2/2007 | Dale et al. | |
| 2009/0266544 | A1 | 10/2009 | Redlinger et al. | |
| 2011/0220357 | A1 | 9/2011 | Segura et al. | |
| 2014/0352964 | A1 * | 12/2014 | Surjaatmadja | E21B 29/002 166/298 |

OTHER PUBLICATIONS

Written Opinion for corresponding International App No. PCT/US2015/023662, dated Jul. 16, 2015, 8 pages.
Hydrawell, HydraWash Product Report, available from http://www.hydrawell.com, 1 page.

* cited by examiner

SINGLE-TRIP CASING CUTTING AND BRIDGE PLUG SETTING

CROSS-REFERENCE TO RELATED APPLICATIONS

This application claims the benefit of, and priority to, U.S. Patent Application Ser. No. 61/972,573, filed Mar. 31, 2014 and entitled "Method and Apparatus for Installation of a Bridge Plug," and U.S. Patent Application Ser. No. 62/055,740, filed Sep. 26, 2014 and entitled "Single-Trip Bridge Plug and Section Mill," which applications are expressly incorporated herein by this reference in their entireties.

BACKGROUND

Downhole bridge plugs may be installed in a wellbore in an oil field services environment in order obstruct fluid flow within the wellbore. For instance, an installed bridge plug may provide a two-way restriction to the flow of liquids, gasses, or combinations of liquids in gasses in the wellbore. When the bridge plug is in place, a lower zone of the wellbore may be isolated from an upper zone to allow a treatment to be conducted on the upper zone. Example treatments may include fracturing, acidizing, cementing, abandonment, casing repair, or other testing, treatment, or remedial operations.

To install the bridge plug, drilling or other downhole tooling is tripped out of the well, and the bridge plug is tripped into the wellbore using a delivery device. Upon reaching the desired position in the geological formation, the bridge plug is actuated and anchored within the wellbore. In the case of a wellbore abandonment operation, the wellbore may be a cased well. The delivery device may be decoupled from the bridge plug and tripped out of the wellbore. A section mill may then be tripped into the wellbore and used to remove a section of casing. Cement may then be inserted into the wellbore and allowed to cure in the section milled portion of the wellbore. In such application, the bridge plug may be used as a barrier to downhole flow of cement, and to facilitate accurate positioning of the cement within the section milled area of the wellbore.

SUMMARY

In an example embodiment, a tool includes a casing cutting tool and a bridge plug. A connector may couple the casing cutting tool to the bridge plug. The tool may be a downhole tool and the casing cutting tool may be a section mill or perforation tool. The connector may releasably couple the casing cutting tool to the bridge plug with a shear element.

In another example embodiment, a method may include deploying a tool string downhole in a wellbore. The tool string may include a casing cutting tool coupled to a bridge plug. The bridge plug may be set in the wellbore. During the same downhole trip in which the bridge plug is set, a casing cutting operation may be conducted using the casing cutting tool.

According to additional example embodiments, methods and tools may be used to ream a portion of a wellbore. The portion of the wellbore that is reamed may be within a section milled portion of a wellbore. A cement remediation process may be performed in some embodiments. In at least some embodiments, cement remediation may be performed in a section of a wellbore where casing cutting includes perforating the casing.

In at least some embodiments, a method for abandoning a well may include tripping a tool string and a bridge plug into a wellbore. The tool string may include a reamer and a section mill. The tool string may also be coupled to the bridge plug using a connector. While downhole, the bridge plug may be set within the wellbore. The bridge plug and connector may be uncoupled from the tool string and the section mill may be activated. The section mill may be used in a section milling operation to form a section milled portion of the wellbore. The reamer may be activated and used in a reaming operation. The reaming operation may form a reamed portion of the wellbore that is within the section milled portion of the wellbore. The tool string may be tripped out of the wellbore while leaving the connector and the bridge plug downhole. Cement may be pumped into the wellbore to form a plug on the bridge plug. The cement may also maintain rock-to-rock engagement within the reamed portion of the wellbore.

The example embodiments provided in this summary are not into limit the aspects of the present disclosure or the claims. Rather, this summary is provided to introduce a selection of concepts that are further developed in the detailed description. This summary is not intended to identify key or essential features of the disclosure or claims, nor is it intended to be used as an aid in limiting the scope of the claimed subject matter.

BRIEF DESCRIPTION OF THE DRAWINGS

FIG. 1-2 is an enlarged, detail view of a connector of the system of FIG. 1-1, the connector facilitating a connection between the bridge plug and the section mill, according to an embodiment of the present disclosure;

FIG. 2-1 is a cross-sectional side view of another embodiment of a system for installing a bridge plug and performing a section milling operation, according to another embodiment of the present disclosure;

FIGS. 2-2 and 2-3 are enlarged, detail views of a hydraulic system for hydraulically actuating the bridge plug of the system of FIG. 2-1, according to an embodiment of the present disclosure;

FIG. 3 is a cross-sectional side view of a connector for coupling a bridge plug to tool string, according to an embodiment of the present disclosure;

FIG. 5-1 is a cross-sectional side view of still another system for installing a bridge plug and performing a section milling operation, according to an embodiment of the present disclosure;

FIG. 5-2 is a perspective view of a connector of the system of FIG. 5-1, the connector facilitating a connection between the bridge plug and a mill, according to an embodiment of the present disclosure;

FIG. 5-3 is a cross-sectional side view of the connector coupled to a distal end of the mill of FIG. 5-2, according to an embodiment of the present disclosure;

FIGS. 6-1 to 6-6 illustrate a method for abandoning a wellbore using a tool string including a bridge plug, a section mill, and a reamer, according to an embodiment of the present disclosure;

FIGS. 8-1 to 8-4 illustrate a method for abandoning a wellbore using a tool string including a perforation tool, a cement remediation tool, and a bride plug, according to an embodiment of the present disclosure;

DETAILED DESCRIPTION

Aspects of the present disclosure may relate to bridge plugs. Additional aspects of the present disclosure may relate to milling systems. More particularly, some aspects of the present disclosure may relate to methods, systems, tools, and apparatus for installing a bridge plug and performing a section milling operation in a single downhole trip. Further aspects of the present disclosure may relate to methods for abandoning a wellbore in an oil field services environment.

Figure 1:
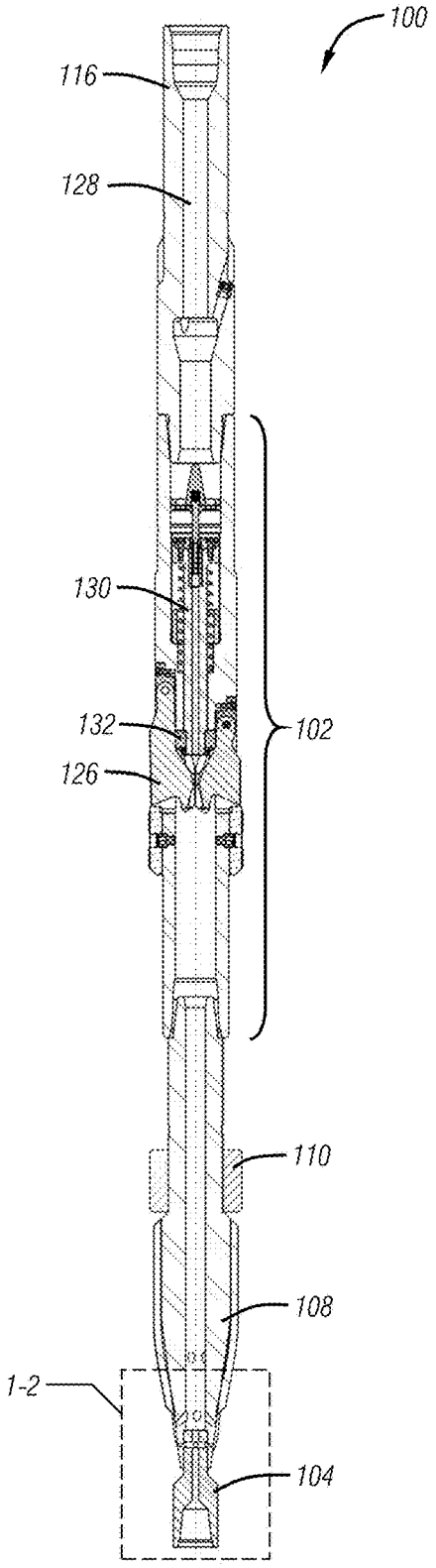
FIG. 1-1 is a cross-sectional side view of a system for installing a bridge plug and performing a section milling operation, according to an embodiment of the present disclosure.
Figures 1, 2:
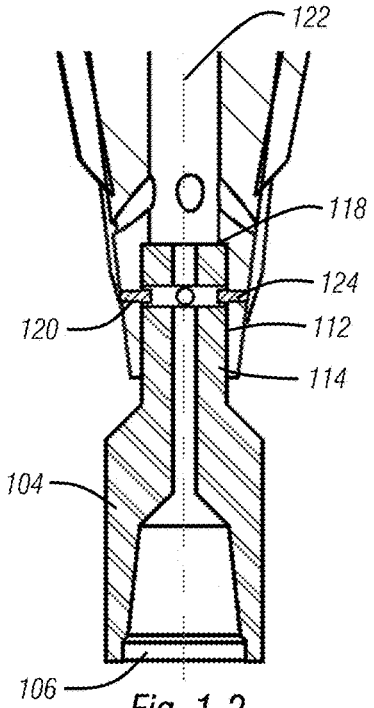

Referring to FIGS. 1-1 and 1-2, a downhole tool 100 is illustrated in accordance with some embodiments of the present disclosure. In at least some embodiments, the downhole tool 100 may be used to set a bridge plug (not shown) and to perform an additional downhole operation in a single trip. Examples of additional operations that may be performed in a single trip include section milling and/or reaming operations. In other embodiments, however, additional or other downhole operations (e.g., fracturing, acidizing, cementing, etc.) may be performed in a single trip during which a bridge plug is set within the wellbore.

According to some embodiments, the downhole tool 100 may include a section mill 102 and a connector 104. The section mill 102 may be directly or indirectly coupled to the connector 104, and the connector 104 may be configured to be coupled to the bridge plug. In the illustrated embodiment, for instance, the connector 104 may include a distal end 106 having a box connection thereon. The box connection may be threaded and configured to mate with corresponding threads on a pin connection of a bridge plug. In other embodiments, however, other releasable or permanent connections may be used. For instance, welds, pins, threaded connectors, other couplings, or combinations of the foregoing may be used to facilitate coupling the connector 104 to the bridge plug.

The connector 104 may be coupled to the section mill 102 using in any number of different manners. In some embodiments, for instance, the connector 104 may be coupled directly to the section mill 102 (e.g., via a weld, threaded box and pin connection, or the like). In other embodiments, the connector 104 may be integrally formed with the section mill 102. In still other embodiments, such as that illustrated in FIGS. 1-1 and 1-2, the connector 104 may be indirectly coupled to the section mill 102 by one or more intermediate components. In this particular example, for instance, a lead mill 108 and/or a stabilizer 110 may be located between the section mill 102 and the connector 104. In other embodiments, reamers, drill collars, drill pipe, transition drill pipe, or other components may be located between the section mill 102 and the connector 104.

In the illustrated embodiment, lead mill 108 may be a taper mill, window mill, or the like, and the connector 104 may be coupled to a nose or face of the lead mill 108. In some embodiments, the lead mill 108 may include grooves 112. The grooves 112 may include depressions, slots, female connectors, or other features formed on the lead mill 108. The grooves 112 may extend longitudinally along an interior surface of the lead mill 108, and may be configured to mate with corresponding splines 114 of the connector 104. The splines 114 may include protrusions, ridges, male connectors, or the like formed on, or connected to, an outer surface of the connector 104. The grooves 112 and splines 114 may be linear, curved, helical, angled, or have any other suitable shape or configuration. Regardless of the specific configuration, the splines 114 may mate with the grooves 112 to orient the lead mill 108 with respect to the connector 104 and/or to couple the connector 104 to the lead mill 108. Such a connection may also allow torque from a drill string 116 coupled to the section mill 102 to be transmitted from the surface of a wellbore, to the connector 104, and potentially to a bridge plug. Such rotation may, in some embodiments, be used to activate the bridge plug and/or to decouple the bridge plug from one or more of the downhole tool 100, the section mill 102, the lead mill 108, or the connector 104.

To further facilitate transmission of torque from the lead mill 108 to the connector 104, the lead mill 108 may, according to some embodiments of the present disclosure, include a shoulder 118 and/or openings 120. The shoulder 118 may be an internal shoulder on an internal surface of the lead mill, and may be configured to abut or mate with a shoulder or an upper end portion of the connector 104. The openings 120 may include holes, apertures, or other features. In the illustrated embodiment, the openings 120 may extend radially outward from a longitudinal axis 122 of the downhole tool 100, and through a body of the lead mill 108. Although shown as extending radially in a direction that is about perpendicular to the longitudinal axis 122, the openings 120 may be oriented at other angles. For instance, the openings 120 may, in some embodiments, be oriented at an angle that is between 5° and 90° relative to the longitudinal axis 122. In some embodiments, a single opening 120 may be provided in the lead mill 108.

The openings 120 may be configured to receive or otherwise mate with one or more pins 124. The pins 124 may be shear pins, shear bolts, or other shear elements in some embodiment, and may be configured to break when a predetermined amount of axial and/or rotational force is applied thereto. Where the pins 124 are shear bolts, the openings 120 may be threaded openings. In use, the pins 124 may couple the connector 104 to the lead mill 108 while tripping the downhole tool 100 into a wellbore. The connector 104 may be connected to a bridge plug that is activated by using mechanical, hydraulic, electrical, other mechanisms, or some combination of the foregoing. When activated, the bridge plug may be set and anchored within the wellbore and may resist axial and/or rotational motion.

After activation of the bridge plug, an axial force (e.g., tension or compression) and/or rotational force may be applied to the downhole tool 100. The force may be transmitted to the lead mill 108 and to the pins 124. The force on the pins 124 may exceed the predetermined force at which the pins 124 are designed to break. When such forces are applied and the pins 124 break, the connector 104 may be released from the lead mill 108. By then moving the downhole tool 100 axially upward (optionally with some rotational movement), the section mill 102 and lead mill 108 may move uphole relative to the connector 104, which may remain downhole with the set bridge plug. In other embodiments, however, the pins 124 or other device may be configured to decouple the connector 104 from the bridge plug rather than from the lead mill 108 or other component of the downhole tool 100.

While FIGS. 1-1 and 1-2 illustrate an embodiment which, in cross-section, has two (2) openings 120 and pins 124, the number of openings 120 and pins 124 may vary. For instance, there may be a single opening 120 and pin 124. In other embodiments, there may be more than two (2) openings 120 and pins 124. For instance, there may be between one (1) and twelve (12) openings 120 and pins 124 in some embodiments of the present disclosure. In still other embodiments, there may be no openings 120 or pins 124, and a threaded connection, burst disc, sacrificial tab, or other component may be provided to couple the downhole tool 100 to the bridge plug.

The use of grooves 112, splines 114, openings 120, and pins 124 are merely illustrative as example mechanisms that may be used to couple the downhole tool 100 to a bridge plug, or more particularly the lead mill 108 to the connector 104. In other embodiments, however, other configurations and mechanisms may be used. For instance, the lead mill 108 may include ridges thereon while the connector 104 includes grooves. A keyed connection, hexagonal or other non-round interface, or the like may also be used to allow transmission of torque to and through the connector 104, or to align the downhole tool 100 with the connector 104. In other embodiments, rather than coupling the connector 104 to an interior of the lead mill 108, the connector 104 may be coupled to an outer surface of the lead mill 108, or connected to some other component entirely. Further, while the connector 104 may be a modular component or tool sub that may be connected and disconnected from the lead mill 108, in other embodiments the connector 104 may be integral with the lead mill 108, the bridge plug, or some other component.

When the section mill 102 and lead mill 108 are decoupled from the connector 104 and/or the bridge plug, the section mill 102 may be positioned to begin a downhole operation. For instance, the section mill 102 may be pulled upward within a wellbore. The section mill 102 may include one or more blades 126 that can be used to cut/mill away casing of a wellbore. In FIG. 1-1, the blades 126 are shown in a retracted position. The blades 126 may, however, be expanded using any number of expansion mechanisms. For instance, fluid may be pumped down a bore 128 within the downhole tool 100. The fluid may act on a piston 130 which may move a cam 132 against an inner surface of the blades 126. In the illustrated embodiment, as the cam 132 moves downward, the cam 132 may cause the blades 126 to pivot and rotate to a radially expanded position. Using a top drive, rotary table, downhole motor, or the like, the drill string 116 may be rotated, which may also cause the blades 126 to rotate. When the blades 126 are expanded, they may cut into the casing. By then moving the downhole tool 100 and the blades 126 downward, the blades 126 may mill away an axial length of the casing around the wellbore.

As should be appreciated by a person having ordinary skill in the art in view of the disclosure herein, the described operation of the section mill 102 in FIG. 1-1 is merely illustrative. In other embodiments, for instance, the section mill 102 may be activated mechanically, electronically, using active or passive radio-frequency identification (RFID) tags, other mechanisms, or some combination of the foregoing. Further, the blades 126 of the section mill 102 may expand and retract by use of a cam moving in an upward direction, by translating the blades 126 radially and axially, or by using a combination of pivoting/rotational and axial movement for the blades 126.

In at least some embodiments of the present disclosure, the downhole tool 100 may be used in connection with a mechanically set bridge plug. For instance, the bridge plug may be set on a bottom of a wellbore and weight may be applied to set and anchor the bridge plug in an openhole or cased portion of the wellbore. The bridge plug may be anchored in place when a first threshold force is applied. In some embodiments, the pins 124 or other mechanism coupling the downhole tool 100 to the bridge plug may remain functional during setting of the bridge plug, and may break, shear, or release when a second, higher threshold force is achieved. In other embodiments, the second threshold force may not be higher than the first threshold force. For instance, the second threshold force may be a different type of force (e.g., rotational force).

Figures 1, 2:
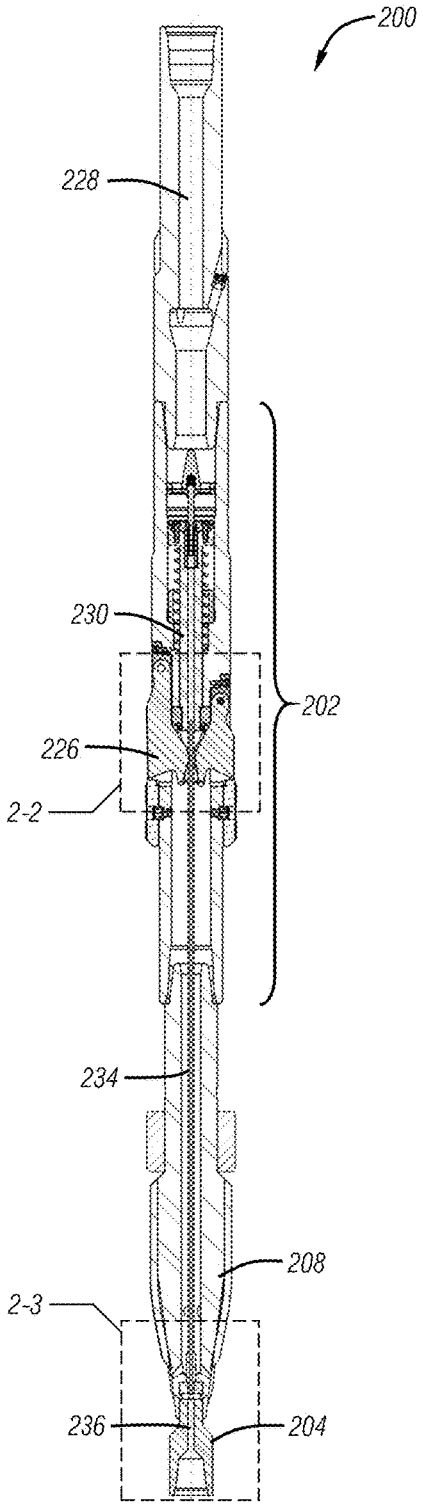
Figure 2:
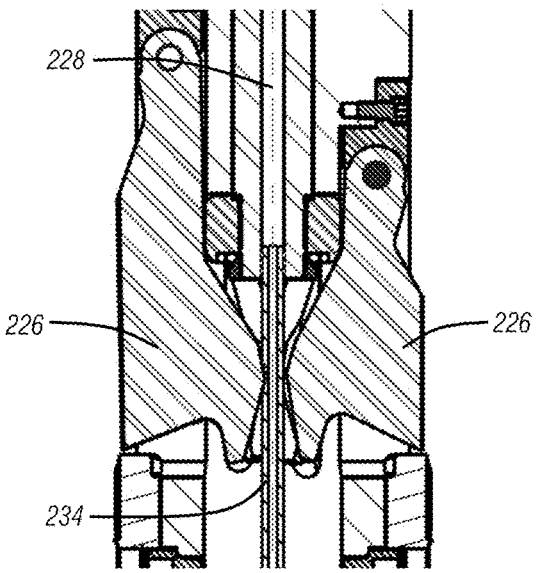
Figures 2, 3:
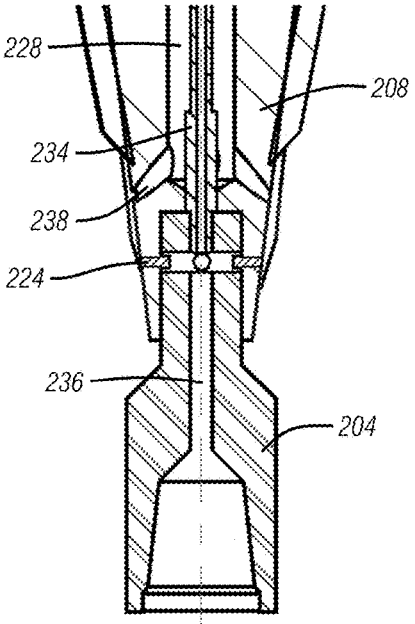
Figure 3:
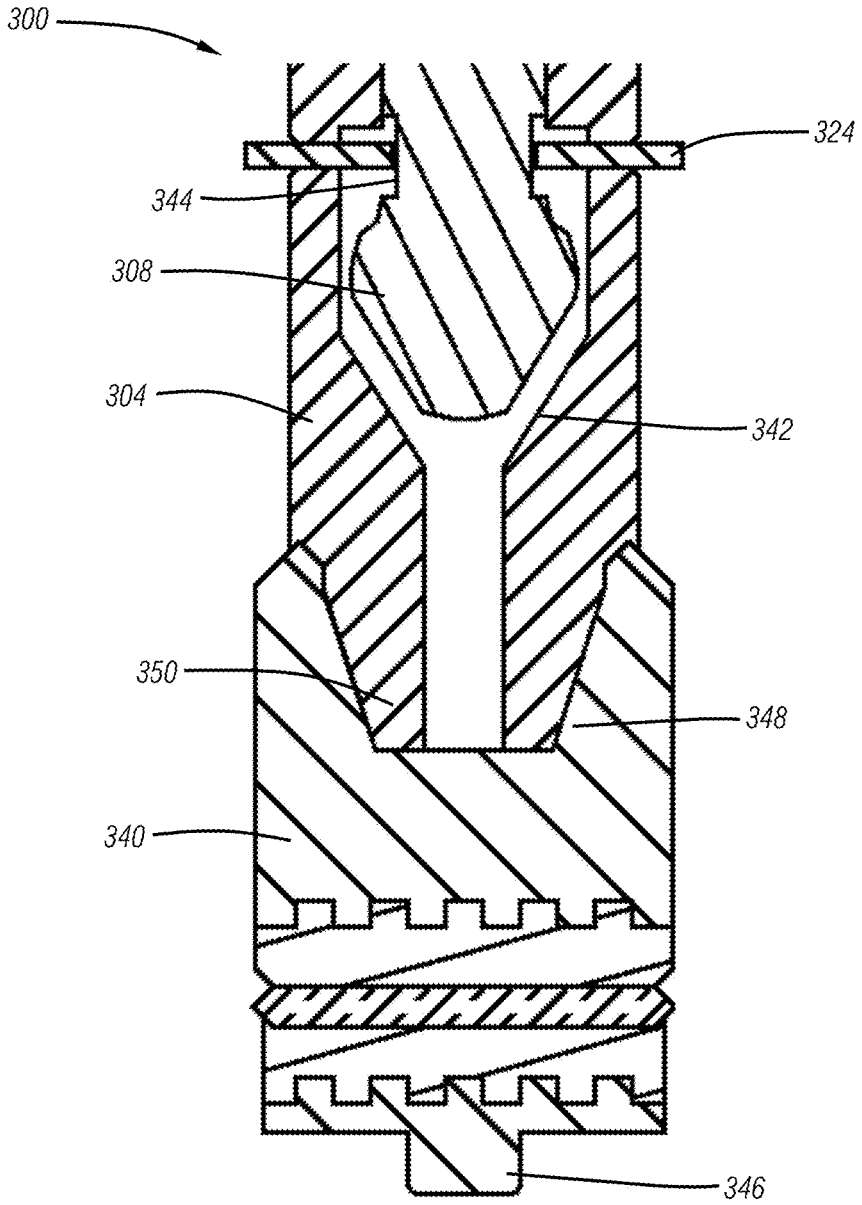

In still other embodiments, the bridge plug may be hydraulically or hydro-mechanically actuated. FIGS. 2-1 to 2-3, for instance, illustrate another embodiment of a downhole tool 200 for use with a bridge plug. In this particular embodiment, however, the downhole tool 200 may be configured to use fluid flow and fluid pressure to at least partially actuate the bridge plug.

More particularly, the downhole tool 200 may include a section mill 202 and a connector 204. The connector 204 may be configured to couple the section mill 202 to a bridge plug (not shown). In at least the illustrated embodiment, the connector 204 may be coupled indirectly to the section mill 202. For instance, the section mill 202 may be coupled to a lead mill 208, and the lead mill 208 may in turn be coupled to the connector 204.

The downhole tool 200 may include a bore 228 extending fully or partially therethrough. In some embodiments, the connector 204 may be a tubular or other component having a bore 236 therein. The bore 228 may be in fluid communication with the bore 236 to allow fluid to flow therein. For instance, fluid may flow through the downhole tool 200 (e.g., through the section mill 202 and the lead mill 208), and into the connector 204 for activation of the bridge plug. Hydraulic pressure may thereby be transmitted from the downhole tool 200 to a bridge plug coupled to the connector 204.

In at least some embodiments, a flow tube 234 may be located within the bore 228 and/or the bore 236. In FIGS. 2-1 to 2-3, for instance, the flow tube 234 may be coupled to a lower or downhole end portion of a piston 230 of the section mill 202. In one embodiment, the flow tube 234 may be press-fit or threadably coupled to the piston 230. In other embodiments, the flow tube 234 may be coupled to the piston 230 or other components of the section mill 202 using shear elements or in other manners. The flow tube 234 may also be coupled to an upper or uphole end portion of the connector 204 using a threaded connection, mechanical fastener, weld, press-fit, shear elements, other coupling mechanism, or some combination of the foregoing. Regardless of the particular types of connections used, as fluid flows into the downhole tool 200 and the flow rate and/or pressure differential increases, fluid exiting the piston 230 may flow through the flow tube 234 and bypass one or more nozzles 238 in the lead mill 208. The fluid may flow through the connector 204 to the bridge plug, and the fluid may be used to activate the bridge plug. After the bridge plug is activated, the downhole tool 200 may be picked up, set down, rotated, or have some other force applied thereto. The tensile and/or rotational forces applied to the downhole tool 200 may shear or otherwise break or release one or more pins 224. The pins 224 may couple the connector 204 to the lead mill 208, to the section mill 202, to a bridge plug, or to another component of the downhole tool 200. The tensile, rotational, or other forces that may shear the pins 224 may also disconnect the flow tube 234 from the piston 230 of the section mill 202. Upon disconnecting the flow tube 234, the section mill 202 may be moved or otherwise positioned, and one or more blades 226 of the section mill 202 may be activated to initiate a milling operation. The flow tube 234 may be an example of a hydro-mechanical activation tool for a bridge plug.

In the configurations described herein, a downhole tool may include a connector configured to be coupled to a bridge plug. The bridge plug may be configured to be activated so as to be set/anchored within a wellbore through either a mechanical, hydraulic, hydro-mechanical, electrical, or other actuation. Once set, the bridge plug may restrict or potentially prevent fluid from flowing within through or around the bridge plug in the wellbore. After setting the bridge plug, section milling, reaming, acidizing, cementing, or other downhole operations may begin.

Referring now to FIG. 3, another embodiment of a connector 304 for coupling a downhole tool 300 to a bridge plug 340 is illustrated. In at least some embodiments, the connector 304 may be a cross-over or tool sub configured to be coupled a lead mill 308 of the downhole tool 300. More particularly, the cross-over sub or other connector 304 of FIG. 3 may be configured to be placed around or otherwise coupled to the exterior of the lead mill 308. For instance, the connector 304 may have a seat 342 therein. The seat 342 may have a shape and configuration corresponding to at least a portion of the exterior surface of the lead mill 308. In this particular embodiment, the lead mill 308 may be received fully within the connector 304; however, in other embodiments a portion of the lead mill 308 (e.g., a nose or face of the lead mill 308) may be received within the connector 304 and/or may mate with the seat 342.

To couple the lead mill 308 to the connector 304, the lead mill 308 may include one or more slots 344 formed therein. In this particular embodiment, the slots 344 may include openings, holes, grooves, or the like formed on an exterior surface of the lead mill 308, a collar coupled to the lead mill 308, or some other component coupled to the lead mill 308. In some embodiments, the slots 344 may extend longitudinally along the lead mill 308. One or more pins 324 may be inserted through the connector 304 and located within the slots 344 to restrict or even prevent relative movement of the connector 304 relative to the lead mill 308 and the downhole tool 300. The pins 324 and slots 344 may optionally allow some movement of the lead mill 308 relative to the connector 304. For instance, when the downhole tool 300 is suspended within a wellbore to place a tensile force on the pins 324, the lead mill 308 may move upward relative to the connector 304 and the pins 324 may be located in a lower portion of the slots 344. When weight is set down on the downhole tool 300 to place a compressive force on the pins 324 (or a compressive force between the lead mill 308 and the seat 342), the lead mill 308 may move downward relative to the connector 304 and the pins 324 may be located in an upper portion of the slots 344. In some embodiments, by setting the weight down on the downhole tool 300, the weight of the downhole tool 300 may be supported by the pins 324.

According to at least some embodiments, when weight is set down on the downhole tool 300, the lead mill 308 may contact the seat 342, and the weight of the downhole tool 300 may be transmitted through the lead mill 308 and seat 342 to the bridge plug 340. In this particular embodiment, the bridge plug 340 may include a plunger 346 or other mechanical actuation tool. By applying the weight of the downhole tool 300 to the bridge plug 340, the plunger 346 may be pressed against a bottom of the wellbore and the bridge plug 340 may be actuated and expanded or otherwise set/anchored within the wellbore. In at least some embodiments, the pins 324 may not shear when the weight of the downhole tool 300 is set down on the connector 304 and the bridge plug 340.

After setting the bridge plug 340, the downhole tool 300 may be pulled upward to perform a pull test to verify the bridge plug 340 has been actuated. In some embodiments, the downhole tool 300 may thereafter be rotated. Rotation of the downhole tool 300 may cause the pins 324 to shear, and the connector 304 to be decoupled from the lead mill 308 and the downhole tool 300. The downhole tool 300 may then be raised to perform a section milling or other downhole operation while the connector 304 remains downhole with the bridge plug 340.

The pins 324 may be sized, shaped, and otherwise configured to allow the bridge plug 340 to be actuated, and to thereafter shear when the lead mill 308 is rotated relative to the connector 304. In some embodiments, the pins 324 may be made of brass, steel, titanium, or some other metal, alloy, or the like. The pins 324 may provide sufficient strength to support axial forces incurred during the pull test and setting of the bridge plug 340, but may then shear when subjected to rotational forces alone or in combination with the axial forces. In other embodiments, the pull test may be used to apply an axial force that shears the pins 324.

The connector 304 may be integrally formed with the bridge plug 340, or coupled thereto in any suitable manner. In FIG. 3, for instance, a threaded connection may be used to couple the bridge plug 340 to the connector 304. In particular, the bridge plug 340 may include a female connector or box 348, and the connector 304 may include a male connector or pin 350. The pin 350 may be threaded into the box 348 to couple the connector 304 to the bridge plug 340. In other embodiments, however, the connector 304 may include a box and the bridge plug 340 may include a mating pin. In still other embodiments, welds, mechanical fasteners, or other connection mechanisms may be used to couple the connector 304 to the bridge plug 340.

Figure 4:
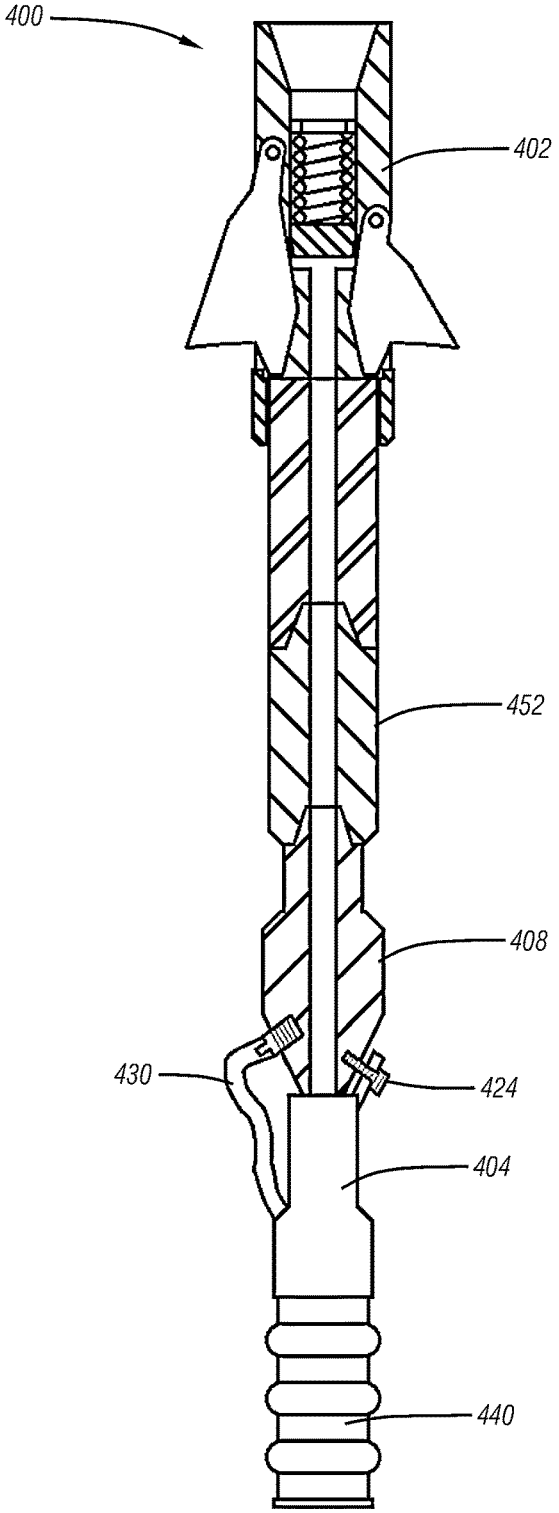
FIG. 4 is a cross-sectional side view of another system for installing a bridge plug and performing a section milling operation, according to an embodiment of the present disclosure.

The bridge plug 340 of FIG. 3 may be set mechanically; however, in other embodiments, and as discussed herein, a bridge plug may be set hydraulically or by using a combination of hydraulic and mechanical forces. FIG. 4, for instance, illustrates another embodiment of a downhole tool 400 that includes a section mill 402 coupled to a bridge plug 440 via a connector 404. In this particular embodiment, the connector 404 may be coupled to a lead mill 408, which may be coupled to the section mill 402 via an intermediate component 452. According to at least some embodiments, the intermediate component 452 may be a running tool configured to allow fluid flowing through the section mill 402 to pass into the lead mill 408 and ultimately into the bridge plug 440.

To further allow fluid to flow downhole to activate the bridge plug 440, some embodiments of the present disclosure may include a flow tube 430. The flow tube 430 may be external or internal to the downhole tool 400. In FIG. 4, for instance, the flow tube 430 may include a flexible hose extending between the lead mill 408 and the connector 404 or bridge plug 440. Such a hydraulic connection may be similar, for instance, to a hydraulic connection between a taper mill and a whipstock used in sidetracking operations.

When hydraulic fluid flows through the flow tube 430 and into the connector 404, the flow may be directed into the bridge plug 440, thereby causing the bridge plug 440 to expand or otherwise set/anchor within the wellbore. In at least some embodiments, the bridge plug 440 may include a hydraulic set packer. In other embodiments, the fluid flow may set a hydraulic set packer which may in turn set/anchor the bridge plug 440. To initiate fluid flow to set the bridge plug 440, fluid may be pumped from surface. In other embodiments, commands for actuation may be initiated from a surface or subterranean environment. After activating the bridge plug 440, a pin 424 or other sacrificial element that couples the connector 404 to the lead mill 408 may be broken (e.g., sheared by applying axial force or a rotational force/torque), to allow the downhole tool 400 to move relative to the bridge plug 440 and the connector 404.

Figures 1, 5:
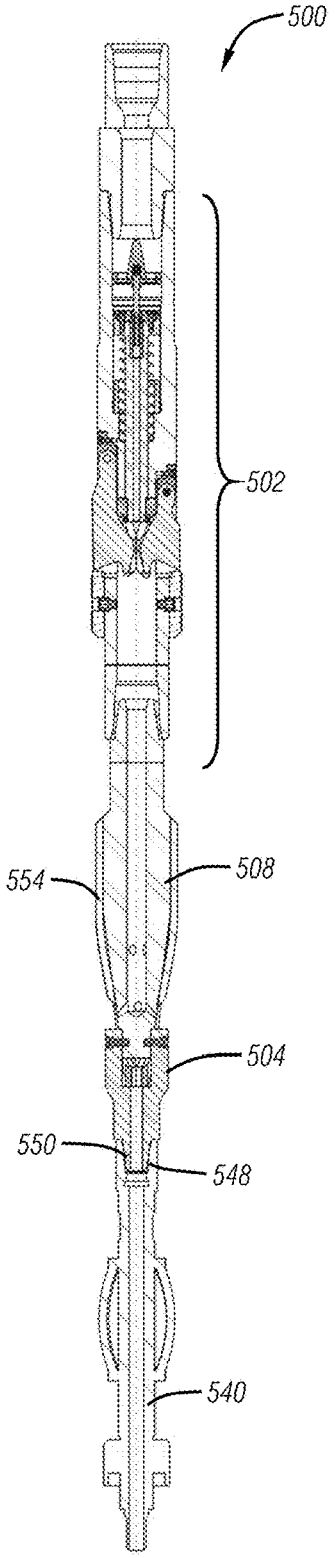
Figures 2, 5:
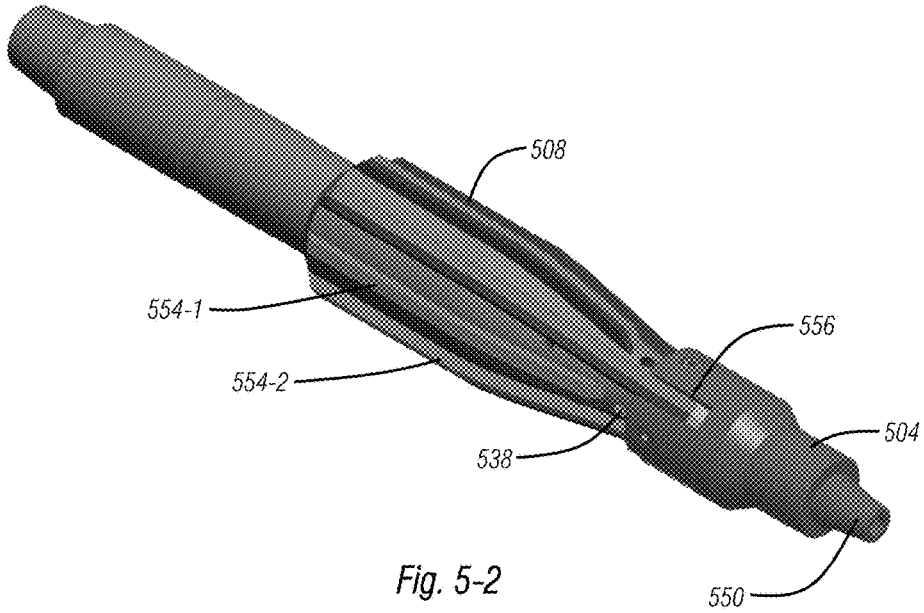
Figures 3, 5:
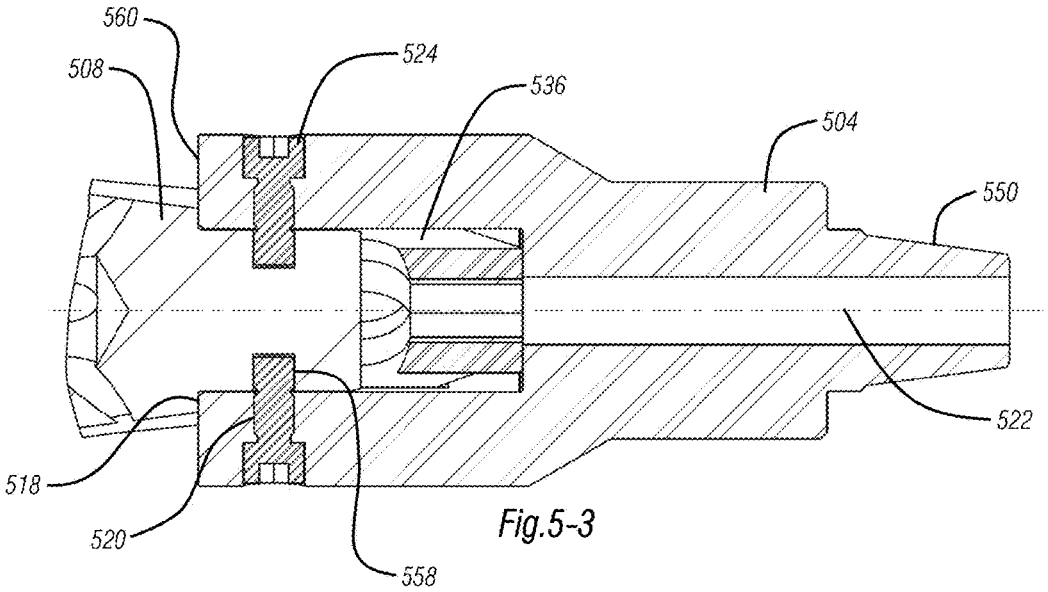

FIG. 5-1 illustrates another example embodiment of a downhole tool 500 that may set or otherwise install a bridge plug 540 and perform a section milling operation in a single trip. In particular, the downhole tool 500 may include a section mill 502 coupled to a bridge plug 540 via a lead mill 508 and a connector 504. It should be appreciated in view of the disclosure herein that such an arrangement is illustrative, and that other embodiments are contemplated. For instance, the lead mill 508 may be omitted in some embodiments, or replaced with a stabilizer, drill collar, or other component.

The downhole tool 500 may operate in manner similar to other downhole tools discussed herein. For instance, in this embodiment, the connector 504 may include a pin connector 550 configured to threadingly mate with a box connector 548 of the bridge plug 540. As will be appreciated in view of the disclosure herein, other connection mechanisms may also be used. Further, as shown in greater detail in FIGS. 5-2 and 5-3, the connector 504 may be configured to mate with or otherwise couple to an external surface of the lead mill 508.

More particularly, the connector 504 of FIGS. 5-1 to 5-3 may be configured to be coupled around (e.g., concentrically around) at least a face or nose portion of the lead mill 508. In some embodiments, the lead mill 508 may include blades 554 extending therealong, and which may extend to or near the face of the lead mill 508. In such embodiments, the connector 504 may be configured to couple to the lead mill 508, and potentially without interfering with the blades 554. In some embodiments, at least some of the blades 554 may be used to orient the connector 504 relative to the downhole tool 500 and/or to facilitate transmission of torque from the downhole tool 500 to the connector 504.

More particularly, the lead mill 508 illustrated in FIG. 5-2 may include a first set of blades 554-1 that are circumferentially offset around the lead mill 508, and which do not extend to the face of the lead mill 508. A second set of blades 554-2 may also be circumferentially offset around the lead mill 508, but may extend to or near the face of the lead mill 508. As also shown in FIG. 5-2, the connector 504 may include a set of slots 556 sized and oriented to be aligned with, and to receive, the second set of blades 554-2. In this manner, the connector 504 may be oriented to align the second set of blades 554-2 with the slots 556, and the connector 504 may then be slid over the nose or face of the lead mill 508. In operation, as the downhole tool 500 is rotated, the blades 554-2 within the slots 556 may act as splines to transmit torque from the downhole tool 500 to the connector 504.

The slots 556 are shown as extending through a full thickness of the connector 504, so as to be open on an exterior surface of the connector 504. In other embodiments, however, the slots 556 may be internal grooves or the like, and may be closed on the outer surface of the connector 504. In such an embodiment, the outer diameter of the connector 504 may be greater than the outer diameter of the portion of the second set of blades 554-2 within the slots 556. Additionally, in other embodiments, there may be a single set of blades, and each of the blades 554 may be located within a corresponding slot 556.

As shown in FIG. 5-3, when the connector 504 is slid over the nose or face of the lead mill 508, a portion of the lead mill 508 may be positioned within a bore 536 of the connector 504. Accordingly, a distal or downhole end portion of the lead mill 508—which may be the nose or face of the lead mill 508—may be sized, shaped, and configured to be received in the bore 536. In at least some embodiments, the lead mill 508 may include one or more holes 558 or other openings therein. The holes 558 may extend radially through the lead mill 508, and may be oriented about perpendicular to a longitudinal axis 522 of the downhole tool 500, or at another angle relative thereto. For instance, the holes 558 may be oriented at an angle between 10° and 90° relative to the longitudinal axis 522.

The holes 558 may align with corresponding holes or other openings 520 that extend radially within or through the connector 504. The holes 558 may extend at an angle corresponding to the angle of the openings 520. As a result, when the connector 504 is inserted over the face or nose of the lead mill 508, the connector 504 may be oriented to align the holes 558 with the openings 520, and one or more pins 524 may be inserted through the openings 520 and into the holes 558. This may allow the connector 504 to be coupled to the lead mill 508. In such a configuration, the lead mill 508 and connector 504 may be coupled in a manner that restricts or even prevents relative axial and rotational movement between the lead mill 508 and the connector 504. In other embodiments, at least some axial or rotational movement may be allowed. For instance, the openings 520 and/or the holes 558 may be slots that extend longitudinally along the downhole tool 500, or may be oversized relative to the pins 524. As a result, the pins 524 may slide or otherwise move within the openings 520 and/or holes 558 to allow some axial or rotational movement of the pins 524. In the same or other embodiments, the openings 520 and/or the holes 558 may be formed as an annular groove to allow relative rotation between the lead mill 508 and the connector 504.

As discussed herein, the pins 524 may be configured to shear or otherwise break to decouple the lead mill 508 (or other component of the downhole tool 500) from the connector 504 (or from the bridge plug 540). For instance, after actuating and setting the bridge plug 540 in the wellbore, the downhole tool 500 may be pulled upward. The tensile force on the downhole tool 500 may be transferred to the pins 524, which may shear when the tensile force exceeds a predetermined threshold value. In the same or other embodiments, the lead mill 508 may be rotated to shear the pins 524. Thus, axial forces, rotational forces, or a combination of axial and rotational forces may be used to shear the pins 524 and decouple the lead mill 508 and the connector 504.

In some embodiments, one or more alignment features may also be provided facilitate alignment of the openings 520 of the connector 504 with the holes 558 of the lead mill 508. For instance, the connector 504 may include slots 556 as discussed herein for mating with corresponding blades 554. In some embodiments, the lead mill 508 may include a shoulder 518 formed on an exterior surface thereof. The axial distance between the shoulder 518 and the holes 558 may be about the same as an axial distance between an upper surface 560 of the connector 504 and the openings 520. As a result, when the connector 504 is inserted around the nose or face of the lead mill 508, the upper surface 560 may engage the shoulder 518. The openings 520 may therefore be located at a same axial position as the holes 558. Rotation of one or both of the lead mill 508 or connector 504 may then occur to azimuthally align the openings 520 and the holes 558. In other embodiments, keyed surfaces, slots 556 and blades 554, or the like may be used to azimuthally orient the lead mill 508 and the connector 504.

In some embodiments, and as shown in FIG. 5-2, the lead mill 508 may include one or more nozzles 538. In at least some embodiments, the connector 504 may be coupled to the lead mill 508 without covering or restricting flow through the nozzles 538. Such an embodiment is illustrative, and in other embodiments, one or more of the nozzles 538 may be partially or fully covered by the connector 504. For instance, the lead mill 508 may be used as more of a stabilizer or guide than as a mill for milling steel or other materials in or around a wellbore, such that the nozzles 538 may not be used to flow cuttings away from the nose or face of the lead mill 508. In another embodiment, the connector 504 may be decoupled from the lead mill 508 prior to use of the lead mill 508 in milling, and decoupling the connector 504 from the lead mill 508 may uncover the nozzles 538. In still other embodiments, the lead mill 508 may not include nozzles 538, or the lead mill 508 may be replaced by a stabilizer, section mill, running tool, or other component that couples to the connector 504.

In still other embodiments, the connector 504 may be modified to couple to a bridge plug or downhole tool in other manners. For instance, the connector 504 may be integrally formed with the lead mill 508, the bridge plug 540, the section mill 502, or some other component of a downhole tool or bottomhole assembly. Additionally, while the connector 504 is shown as being concentric with the lead mill 508, in other embodiments an axis of the connector 504 may be radially and/or angularly offset from the longitudinal axis 522 of the downhole tool 500. For instance, the connector 504 may include a rib, plate, or extension (see FIG. 4) in addition to, or instead of, a tubular element that is positioned around or within the lead mill 508.

Embodiments of the present disclosure may relate to systems, apparatus, and methods for installing a bridge plug in a downhole environment. The installation of a bridge plug in a downhole environment may restrict or even prevent fluid flow between different sections of a wellbore drilled in a geological formation. The placement of the bridge plug may also restrict or even prevent fluids from being transfer between geological layers and subsequent contamination between these layers.

In some embodiments of the present disclosure, a bridge plug may be coupled to the lower end of a bottomhole assembly that may include a mill or multiple mills. In certain embodiments described herein, lead mills (e.g., taper mills) and section mills may be used. A person of ordinary skill in the art will appreciate in view of the disclosure herein that a section mill may be used in certain embodiments without use of a lead mill.

According to some embodiments of the present disclosure, bridge plugs may be used in well abandonment procedures. For instance, a bridge plug may be used in a first downhole stage of a cementing or well abandonment process. The setting of the bridge plug may be accomplished through mechanical, hydraulic, hydro-mechanical, electrical, or other setting actions. For hydraulic and hydro-mechanical setting actions, the hydraulic forces may be generated through actuation of pump systems located either at the surface or within the wellbore.

In downhole systems, drill string or downhole "trips" are accomplished in order to accomplish specific acts. A downhole trip may entail inserting and removing a bottomhole assembly. A first trip may therefore include inserting a bottomhole assembly, optionally performing a downhole operation, and then removing the bottomhole assembly. A second trip may include re-inserting the bottomhole assembly (or inserting a different bottomhole assembly), optionally performing another downhole operation, and removing the bottomhole assembly. Each trip may entail large amounts of rig time to insert and remove components. In some embodiments of the present disclosure, installation of a bridge plug and section milling to facilitate wellbore abandonment may occur in a single trip. After the insertion and setting of the bridge plug, the drill string used as the conveyance or delivery device for the bridge plug may remain downhole. A section mill coupled to the drill string may then be activated and a section milling operation may be performed. The section milling operation may remove a portion of casing to expose the geological formation within a section milled zone of the wellbore. In a subsequent cementing operation, cement may be placed within the section milled zone and may cure and bond with the geological formation. In some embodiments of the present disclosure, a downhole tool may be modified to allow bridge plug activation, section milling, and cementing to occur in a single trip.

Figures 1, 6:
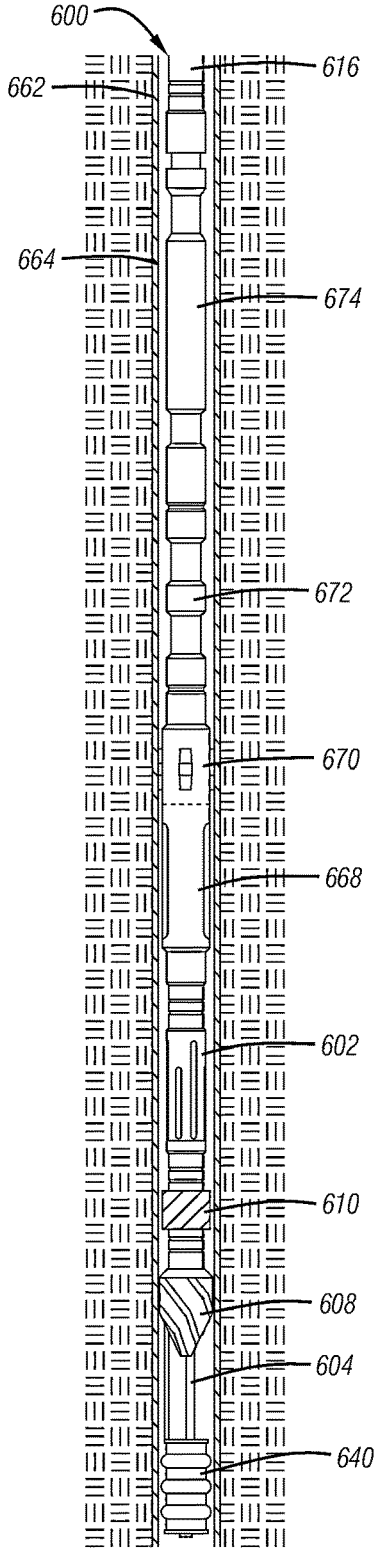
Figures 2, 6:
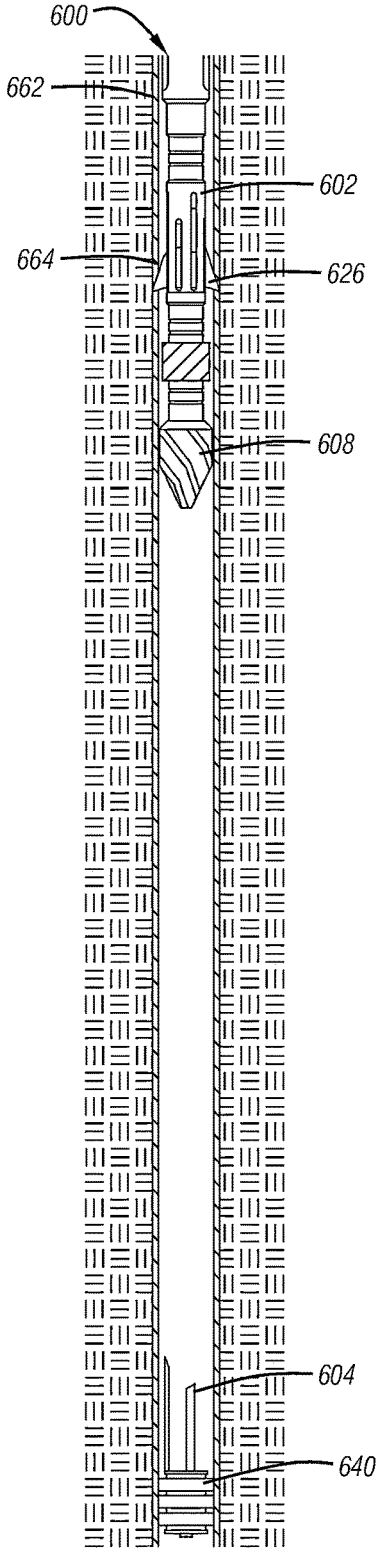
Figures 3, 6:
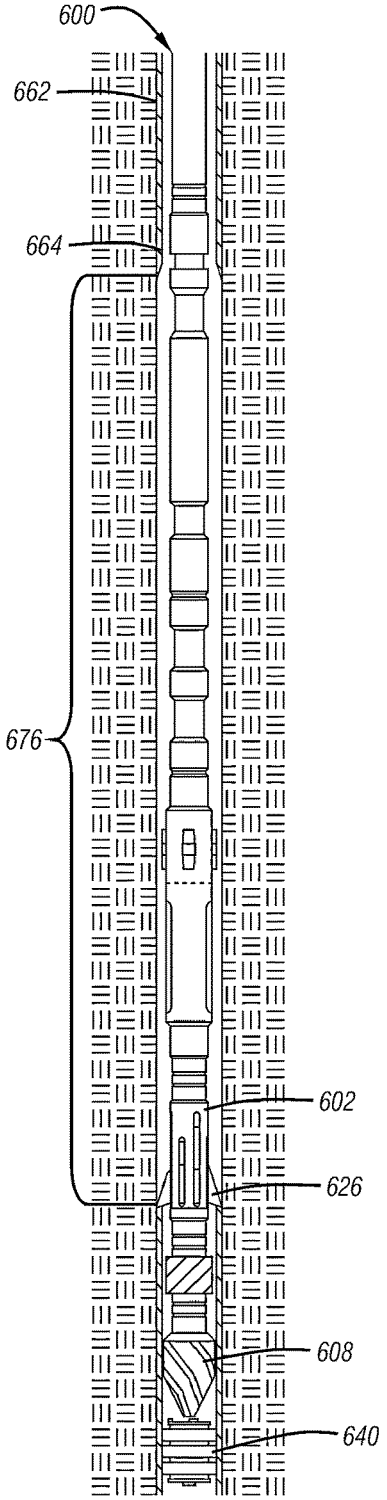
Figures 4, 6:
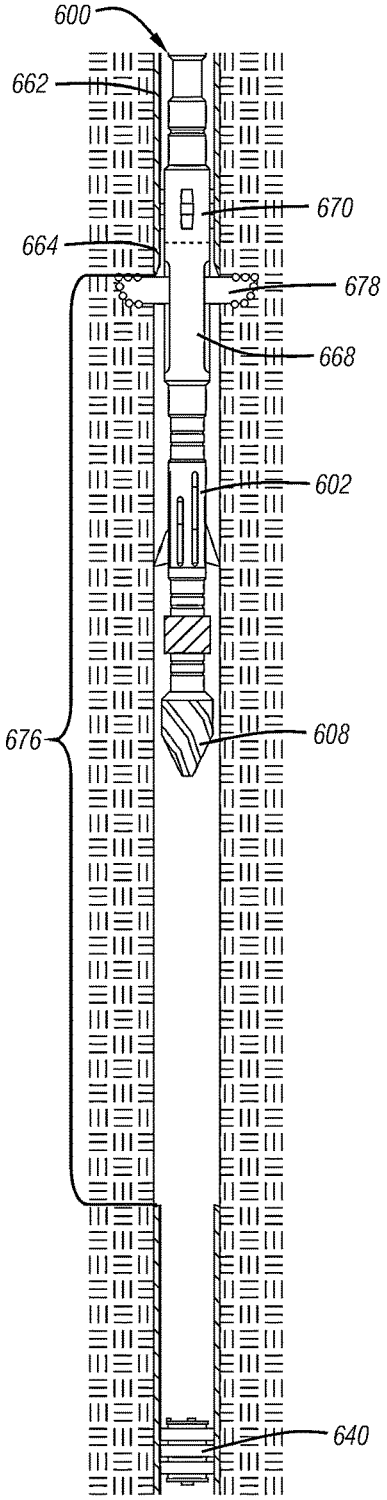
Figures 5, 6:
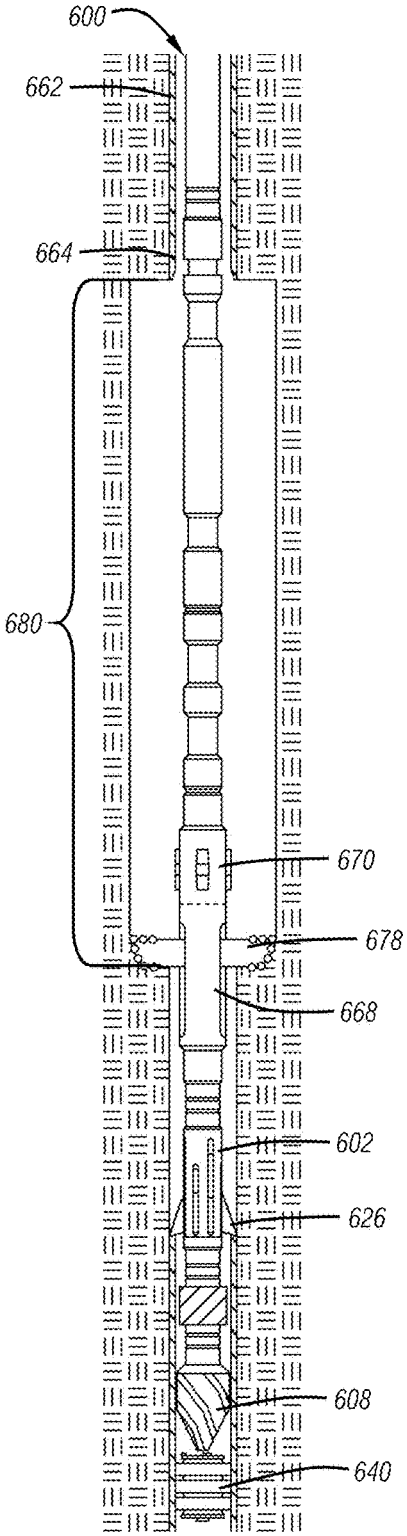
Figure 6:
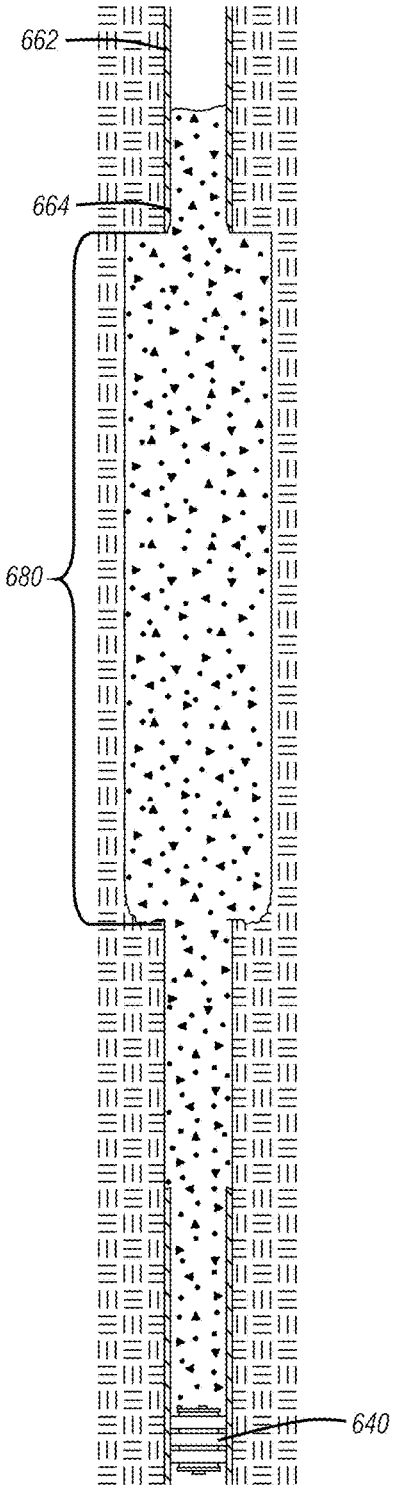

Referring now to FIGS. 6-1 to 6-6, additional embodiments of a downhole tool 600 are illustrated in various stages of a wellbore abandonment process. The various stages shown are representative, and additional or other stages may be included within the wellbore abandonment process, or stages may be performed in different orders. In other embodiments, various stages shown may not be used in a wellbore abandonment process.

More particularly, FIG. 6-1 illustrates the downhole tool 600 after being tripped into a wellbore 662. In this particular embodiment, the wellbore 662 is a cased wellbore and includes casing 664 installed therein. In other embodiments a wellbore may be an openhole wellbore or may include both openhole and cased portions.

The downhole tool 600 that is tripped into the wellbore 662 may include any number of components. In this particular embodiment, for instance, the downhole tool 600 is shown as including a section mill 602 coupled to a bridge plug 640. Additional components may be located between the section mill 602 and the bridge plug 640 in some embodiments. For instance, the downhole tool 600 may include a stabilizer 610 and a lead mill 608. The stabilizer 610 may be a full gauge stabilizer or an undergauge stabilizer. The lead mill 608 may be a taper mill, window mill, follow mill, dress mill, or the like. The lead mill 608 may optionally include blades, cutting inserts, hardfacing, or other cutting or gauge retention elements. A connector 604 may be used to couple the bridge plug 640 to the downhole tool 600 (e.g., to the lead mill 608). In the same or other embodiments, other running tools, including drill collars, transition drill pipe, circulation subs, or other components may be located between the section mill 602 and the bridge plug 640.

Additional components are also illustrated as being included on the downhole tool 600, and optionally uphole of the section mill 602. For instance, the downhole tool 600 may include a reamer 668. The reamer 668 is shown as being coupled to, or including, an optional stabilizer 670. More particularly, the stabilizer 670 may be formed on the body of the reamer 668; however, in other embodiments the stabilizer 670 may be a separate component or sub on the downhole tool 600. The stabilizer 670 may be located adjacent the reamer 668, and potentially immediately adjacent thereto. Other example and optional components of the downhole tool 600 may include transition drill pipe 672 (e.g., heavyweight drill pipe), jars 674, drill pipe 616, drill collars, vibration tools, downhole motors, sensor subs, measurement-while-drilling tools, logging-while-drilling tools, other tools, or any combination of the foregoing. Moreover, the various tools may be re-arranged from the arrangement shown in FIG. 6-1. Thus, some tools may be omitted while other tools may be moved around to be arranged in a different order.

Regardless of the particular components of the downhole tool 600, the downhole tool 600 may be tripped into the wellbore 662. Tripping the downhole tool 600 into the wellbore 662 may include using drill pipe 616, which may be segmented drill pipe, coiled tubing, or the like as a conveyance or delivery device. Where coiled tubing is used, the downhole tool 600 may include or be coupled to a downhole motor (e.g., a mud motor, turbine-drive motor, etc.) which may use fluid flow to rotate a drive shaft that in turn rotates components of the downhole tool 600.

Using the downhole tool 600, the bridge plug 640 may be activated and set within the wellbore 662. For instance, as discussed herein, the bridge plug 640 may be activated by mechanical, hydraulic, hydro-mechanical, electrical, other mechanisms, or some combination of the foregoing.

In a single-trip system, the downhole tool 600 may be used to perform additional downhole operations in addition to setting of the bridge plug 640, and without tripping out of the wellbore 662. According to some embodiments, the additional downhole operations may be performed after setting the bridge plug 640. For some operations, the bridge plug 640 may be decoupled from the downhole tool 600 prior to performing the downhole operation. FIG. 6-2 illustrates the downhole tool 600 after the bridge plug 640 has been activated and decoupled from the downhole tool 600. In particular, the connector 640 has, in this embodiment, been decoupled from the downhole tool 600, and may remain downhole with the bridge plug 640. In other embodiments, the connector 604 may remain coupled to the downhole tool 600, or portions of the connector 604 may remain coupled to each of the bridge plug 640 and the downhole tool 600.

In addition to being decoupled from the bridge plug 640, the downhole tool 600 of FIG. 6-2 has been moved uphole relative to the bridge plug 640. The distance the downhole tool 600 is moved may be varied, and in some embodiments the distance may be sufficient to allow for a section milling operation to be performed to remove a section of the casing 664. For instance, in some embodiments, the downhole tool 600 may be moved uphole a distance between 50 feet (15.2 m) and 500 feet (152.4 m). More particularly, the downhole tool 600 may be moved uphole a distance that is within a range having lower and upper limits that include any of 50 feet (15.2 m), 100 feet (30.5 m), 150 feet (45.7 m), 200 feet (61.0 m), 250 feet (76.2 m), 300 feet (91.4 m), 400 feet (121.9 m), 500 feet (152.4 m), or any value therebetween. In other embodiment, the downhole tool 600 may be moved uphole less than 50 feet (15.2 m) or more than 500 feet (152.4 m).

In some embodiments, when the downhole tool 600 is moved the desired distance after setting and separating from the bridge plug 640, the section mill 602 may be activated to begin a section milling operation. Activation of the section mill 602 may occur in any number of suitable manners. For instance, the section mill 602 may be hydraulically activated. A piston, ball seat, or the like may be used to develop a pressure differential suitable for hydraulically activating the section mill 602. In other embodiments, mechanical, electrical, RFID, wireless, or other activation mechanisms may be used. Combinations of the foregoing may also be used to activate the section mill 602.

Activating the section mill 602 may include activating one or more blades 626 configured to cut the casing 664 within the wellbore 662. In FIG. 6-2, for instance, the section mill 602 may include multiple blades 626. The blades 626 may be moved (e.g., rotated and/or translated) from a retracted state in which the blades 626 are within a housing of the section mill 602 (FIG. 6-1) to an expanded state in which the blades 626 are moved radially outward into engagement with the casing 664 (FIG. 6-2). During or after expansion of the blades 626, the downhole tool 600 may be rotated. Rotation of the downhole tool 600 may cause the blades 626 to cut radially into (and potentially fully through) the casing 664.

While continuing to rotate the downhole tool 600, the downhole tool 600 may then be moved downward within the wellbore 662. When moving axially within the wellbore 662, the blades 626 may continue to cut the casing 664, and may perform a face milling operation that mills out an axial length of the casing 664. As shown in FIG. 6-3, for instance, the downhole tool 600 has been moved downhole toward the bridge plug 640 to create a section milled portion 676 of the wellbore 662. The length of the section milled portion 676 may vary. In some embodiments, for instance, the section milled portion 676 may be more or less than the distance the downhole tool 600 is moved after setting the bridge plug 640. For instance, the section milled portion 676 may have a length between 25 feet (7.6 m) and 450 feet (137.2 m). More particularly, the section milled portion 676 may have a length within a range including lower and upper limits that include any of 25 feet (7.6 m), 50 feet (15.2 m), 75 feet (22.9 m), 100 feet (30.5 m), 125 feet (38.1 m), 150 feet (45.7 m), 200 feet (61.0 m), 300 feet (91.4 m), 450 feet (137.2 m), or any value therebetween. In other embodiments, the length of the section milled portion 676 may be less than 25 feet (7.6 m) or more than 450 feet (137.2 m).

In the section milling operation, the casing 664 may be entirely removed from the section milled portion 676 of the wellbore 662. This may allow, for instance, a later cementing operation to be used to form a cement plug that can directly contact the geological formation around the wellbore 662, to form a rock-to-rock seal. In some embodiments, however, less than a full amount of the casing may be removed from the milled portion 676 of the wellbore 662, or the geological formation may not be exposed along at least a portion of the length of the section milled portion 676. For instance, the section mill 602 may not be concentric within the wellbore 662. This may be particularly likely where, for instance, the wellbore 662 is a deviated or angled borehole and the weight of the section mill 602 causes the section mill 602 to drop to the lower side of the wellbore 662. As a result, during the section milling operation, the blades 626 of the section mill 602 may cut more deeply into one side of the casing 664 than the other, potentially cutting more deeply on one side of the wellbore 662, and more shallowly on the other side of the wellbore 662. Additionally, the casing 664 may also have an annular cement region (not shown) between the outer surface of the casing 664 and the geological formation. In some embodiments, the section mill 602 may mill fully through the casing 664, but may not cut or mill out a full thickness of cement. As a result, cement may be exposed rather than the geological formation.

Some embodiments of the present disclosure may include performing additional downhole operations in order to ensure that a portion of the wellbore 662 has been opened to allow a rock-to-rock seal for a cement plug. To provide such a seal, some embodiments of the present disclosure may include using a reamer to cut more deeply into the geological formation. For instance, after creating the section milled portion 676 of the wellbore 662 as shown in FIG. 6-3, the downhole tool 600 may be pulled upward. In some embodiments, the downhole tool 600 may be moved to align the reamer 668 at or near an upper portion of the section milled portion 676, as shown in FIG. 6-4. When the downhole tool 600 is moved the desired distance, and the reamer 668 is at the desired position within the section milled portion 676, the reamer 668 may be activated to begin a reaming operation. Activation of the reamer 668 may occur in any number of suitable manners. For instance, the reamer 668 may be hydraulically activated. A piston, ball seat, or the like may be used to develop a pressure differential used to activate cutter blocks 678. In other embodiments, mechanical, electrical, RFID, wireless, or other activation mechanisms may be used. Combinations of the foregoing may also be used to activate the reamer 668.

Activating the reamer 668 may include activating one or more cutter blocks 678 configured to cut the geological formation around the wellbore 662. The cutter blocks 678 may include cutting elements specifically configured to ream and cut the geological formation. In FIG. 6-4, the reamer 668 may include multiple cutter blocks 678. The cutter blocks 678 may pivot or translate radially to expand from a retracted state in which the cutter blocks 678 are within a housing of the reamer 668 (FIG. 6-3) to an expanded state in which the cutter blocks 678 expand radially outward past the casing 664 (FIG. 6-4). During or after expansion of the cutter blocks 678, the downhole tool 600 may be rotated. Rotation of the downhole tool 600 may cause the cutter blocks 678 to cut into and remove a portion of the geological formation, as well as potentially a remaining portion of the casing 664 or cement within the section milled portion 676 of the wellbore 662. When the cutter blocks 678 are expanded to begin a reaming operation, the optional stabilizer 670 above the reamer 668 may be within the casing 664, and may stabilize downhole tool 600.

While continuing to rotate the downhole tool 600, the downhole tool 600 may again be moved downward within the wellbore 662 to ream an axial length of the section milled portion 676 of the wellbore 662. As shown in FIG. 6-5, for instance, the downhole tool 600 has been moved downhole toward the bridge plug 640 to create a reamed portion 680 of the wellbore 662. In such an embodiment, the lead mill 608 may move downward out of the section milled portion 676, and back into the casing 664. In such a manner, the lead mill 608 may act as a stabilizer or guide to center the downhole tool 600.

In some embodiments, the reamed portion 680 may be within the section milled portion 676. The length of the reamed portion 680 may vary. The reamed portion 680 may, for instance, be a full length of the section milled portion 676. In other embodiments, the reamed portion 680 may be less than a full length of the section milled portion 676. For instance, the reamed portion 680 may have a length that is between 10% and 100% of the length of the section milled portion 676. More particularly, the reamed portion 680 may have a length that is within a range having upper and lower limits that include any of 10%, 20%, 30%, 40%, 50%, 60%, 70%, 80%, 90%, or 100% of the length of the section milled portion 676, or any value therebetween. In other embodiments, the reamed portion 680 may be less than 10% of the length of the section milled portion 676.

By both section milling and reaming within the wellbore 662, a diameter of the wellbore 662 may be expanded to provide a rock-to-rock, openhole section into which cement may be located for forming a cement plug that creates a seal with the surrounding geological formation. In some embodiments, the cutter blocks 678 may pivot or otherwise expand to have an outer diameter that is greater than an outer diameter of the blades 626 of the section mill 626, when in their expanded state. In at least some embodiments, the reamer 668 may be a so-called high-ratio underreamer. As a high-ratio underreamer, the reamer 668 may have an expanded diameter that is between 120% and 200% the diameter of the body of the reamer 668. More particularly, the expanded diameter may be within a range that includes lower and upper limits including any of 120%, 125%, 130%, 140%, 150%, 160%, 175%, and 200% the diameter of the body of the reamer 668, or any value therebetween. In other embodiment, the expanded diameter may be less than 120% of the diameter of the body of the reamer 668, or more than 200% the diameter of the body of the reamer 668. The expanded diameter of the reamer 668 may also be greater than the expanded diameter of the section mill 602. As a result, the reaming operation may increase the likelihood of removing a full amount of casing and cement in the reamed portion 680 for a rock-to-rock cement seal.

After forming the reamed portion 680 of the wellbore 662, cement may be pumped or otherwise inserted into the wellbore 662 to form a cement seal. As shown in FIGS. 6-5 and 6-6, this may include tripping the downhole tool 600 out of the wellbore 662 and flowing cement into the wellbore 662. The cement may flow down to the bridge plug 640. Cement may then build up on top of the bridge plug 640, within the wellbore 662, and within the reamed portion 680 of the wellbore 662 to create a cement barrier that has a full circumference or perimeter bordered by the geological formation.

In order to flow cement into the wellbore 662, the downhole tool 600 may, in some embodiments, first be tripped out and removed from the wellbore 662. To remove the downhole tool 600, the cutter blocks 678 of the reamer 668 and the blades 626 of the section mill 602 may be retracted. Such retraction may occur in any number of manners. For instance, the cutter blocks 678 and/or blades 626 may retract by stopping or reducing the flow of fluid within the downhole tool 600. In other embodiments, electrical, mechanical, RFID, or other activation mechanisms may be used. In at least some embodiments, the downhole tool 600 may be pulled upward to retract the cutter blocks 678 or the blades 626. For instance, as the downhole tool 600 moves upward toward the surface, the cutter blocks 678 or the blades 626, if expanded, may move out of the section milled portion 676. As the casing 664 may have a smaller internal diameter than the expanded cutter blocks 678 or the blades 626, the cutter blocks 678 and/or the blades 626 may contact the casing 664 when attempting to move upward past the section milled portion 676. Pulling on the downhole tool 600 may cause the casing 664 to exert an opposing downhole directed force on the cutter blocks 678 and/or the blades 626. Such a force may cause the cutter blocks 678 and/or the blades 626 to rotate downward or otherwise retract.

The cutter blocks 678 and the blades 626 may be retracted simultaneously, or at different times. For instance, the cutter blocks 678 may retract when fluid flow is stopped, and the blades 626 may retract upon contacting the upper stump of the casing 664. In some embodiments, the blades 626 may be retracted prior to performing a reaming operation; however, in other embodiments the blades 626 may remain expanded while reaming occurs.

The method illustrated in FIGS. 6-1 to 6-6 is illustrative of one example method for abandoning a wellbore, but a person having ordinary skill in the art will appreciate that the method may be varied in any number of manners, including by using additional or different equipment. For instance, rather than using a section mill that performs a section or face milling operation by moving downward, the section mill may be modified to perform a section or face milling operation by moving upward. Similarly, rather than by reaming downward, a reamer may be a backreamer and ream while moving upward. In still other embodiments, the reamer may be omitted, or multiple reamers may be used. In some embodiments, a single device may be capable of both section milling and reaming.

Figure 7:
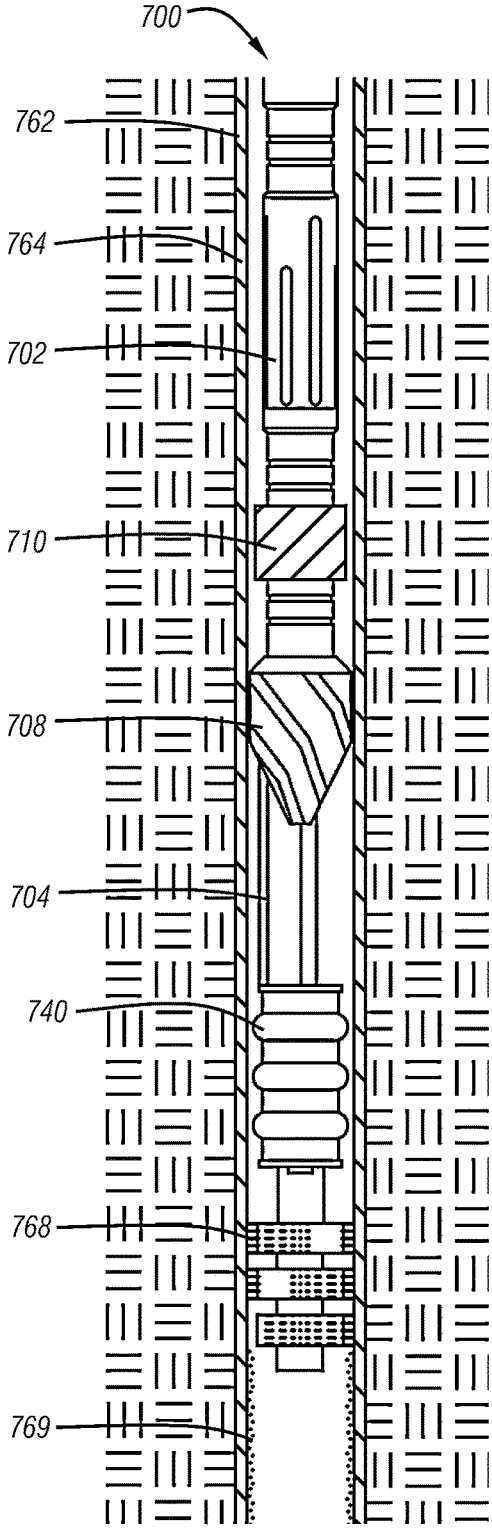
FIG. 7 is a partial, cross-sectional side view of a single trip bridge plug and section mill tool with a wire brush, according to an embodiment of the present disclosure.

Additional or other components may also be included on the BHA or with a downhole tool including a section mill and a bridge plug. FIG. 7, for instance, illustrates an example embodiment of a downhole tool 700 after being tripped into a wellbore 762. In this particular embodiment, the wellbore 762 is a cased wellbore and includes casing 764 installed therein. According to at least some embodiments, the casing 764 may include scale or other debris 769 built-up on an internal surface thereof. The debris 769 may extend along the full or partial length of the casing 764, and the thickness of the debris 769 may be different at different sections of the wellbore 762.

The downhole tool 700 that is tripped into the wellbore 762 may include any number of components, including components discussed elsewhere herein. In this particular embodiment, for instance, the downhole tool 700 is shown as including a section mill 702 coupled to a bridge plug 740 using a connector 704. Additional components may be located on the downhole tool 700 in some embodiments. For instance, the downhole tool 700 may include a stabilizer 710 and/or a lead mill 708. The stabilizer 710 may be a full gauge stabilizer or an undergauge stabilizer. The lead mill 708 may be a taper mill, window mill, follow mill, dress mill, or the like. The lead mill 708 may optionally include blades, cutting inserts, hardfacing, or other cutting or gauge retention elements. The connector 704 may be used to couple the bridge plug 740 to the lead mill 708 or another component of the downhole tool 700. In the same or other embodiments, other running tools, including drill collars, transition drill pipe, circulation subs, or other components may be located on the downhole tool 700 and optionally between the section mill 702 and the bridge plug 740, uphole of the section mill 702, or even downhole of the bridge plug 740.

Additional components are also illustrated as being included on the downhole tool 700, and optionally downhole of the bridge plug 740. For instance, the downhole tool 700 may include a brush 768. The brush 768 may include one or more brush elements formed of wire or some other component, and may be configured to engage the interior surface of the casing 764. In operation, as the downhole tool 700 is tripped into the wellbore 762, the wire or other features of the brush 768 may engage the debris 769 and remove at least a portion thereof from the casing 764.

Running a brush 768 with the downhole tool 700 may allow the casing 764 to be cleaned prior to setting of the bridge plug 740. The brush 768 may be tripped into the wellbore and may slide without rotation, or may rotate to clean the casing 764. In some embodiment, the brush 768 may include a swivel to reduce or prevent the transmission of torque between the brush 768 and the drill string conveying the downhole tool 700 into the wellbore 762. To increase removal of the debris 769 or other solids from the setting area of the bridge plug, the brush 768 may reciprocate axially within the wellbore (potentially by reciprocating the downhole tool 700). Optional fluid ports may also allow drilling fluid or the like to pass to the brush 768 to facilitate movement of the brush 768 within the wellbore, cleaning of debris from the brush 768, and the like. The brush 768 may be used whether the bridge plug 740 is to be set axially or hydraulically. While the brush 768 is shown in FIG. 7 as being positioned below the bridge plug 740, in other embodiments the brush 768 may be positioned above the bridge plug 740.

The downhole tool 700 of FIG. 7 is merely illustrative, and features of the downhole tool 700 may be included in any combination with other components of a downhole tool, including those discussed herein. For instance, the components of the downhole tool 700 may be used in combination with any one or more of expandable stabilizers, reamers, hole openers, transition drill pipe, jars, drill pipe, drill collars, vibration tools, downhole motors, sensor subs, measurement-while-drilling tools, logging-while-drilling tools, coiled tubing, perforation tools, cement remediation tools, cementing tools, disconnect tools, other tools, or any combination of the foregoing. Regardless of the particular configuration of the downhole tool 700, when the setting area for the bridge plug 740 is cleaned, the bridge plug 740 may be positioned in the setting area and secured in place. Securing the bridge plug 740 in the casing 764 may occur before or after other downhole operations (e.g., section milling, reaming, perforating, cement remediation, etc.). After securing the bridge plug 740, the connector 740 may be released from the bridge plug 740 and/or the lead mill 708. A cement plugging operation or other wellbore abandonment procedure may then be performed.

Figures 1, 8:
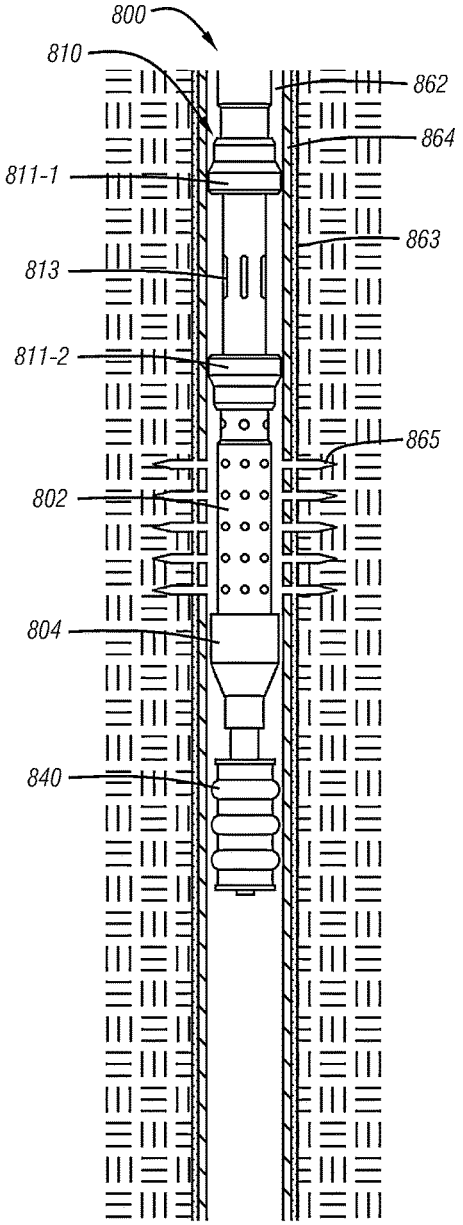
Figures 2, 8:
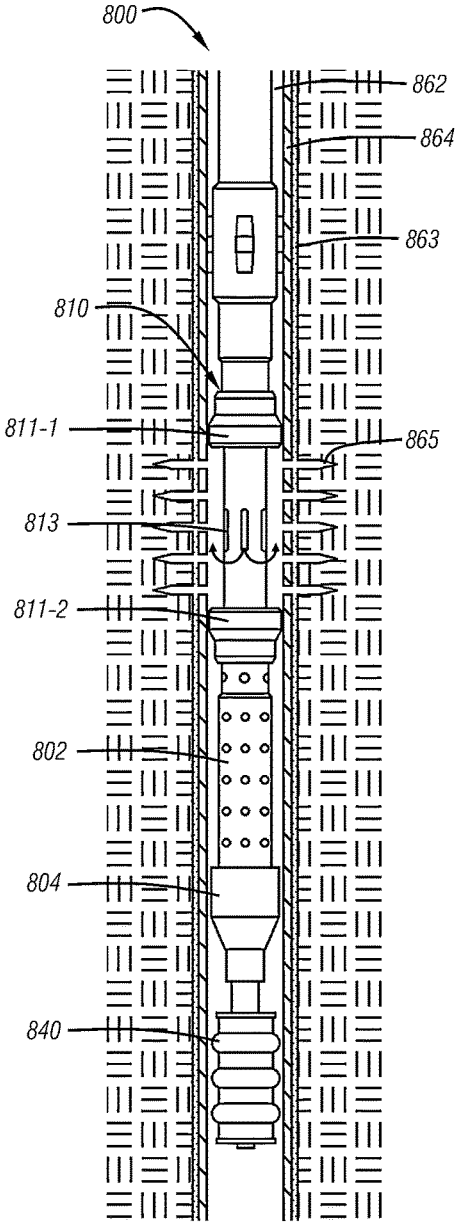
Figures 3, 8:
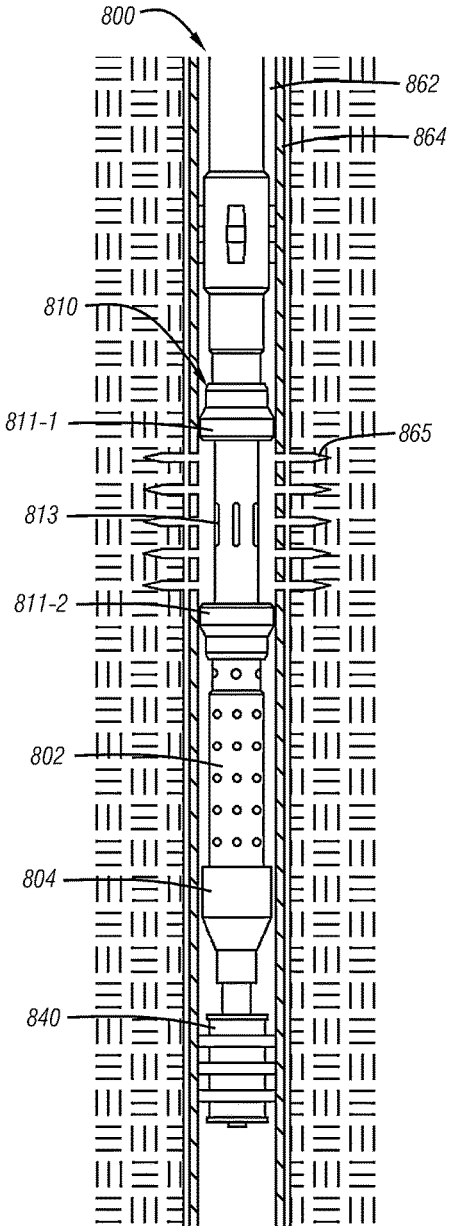
Figures 4, 8:
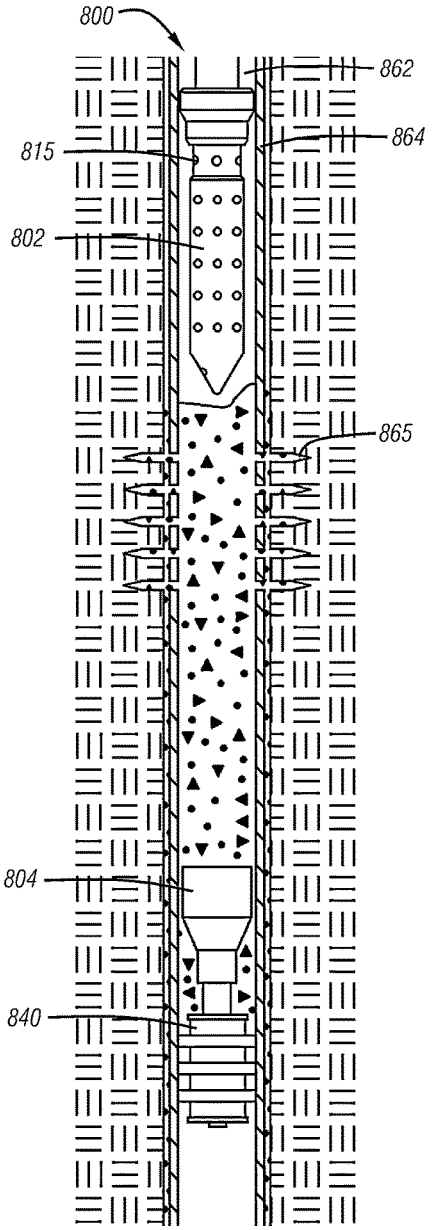

While some embodiments of the present disclosure generally relate to single trip systems and methods for wellbore abandonment in which section milling and setting of a bridge plug are performed in a single trip, other embodiments of the present disclosure may relate to other or additional wellbore abandonment procedures. For instance, in addition to a section milling process, or instead of section milling, a cement remediation process may be performed in a single trip with setting of a bridge plug. FIGS. 8-1 to 8-4, for instance, illustrate an example wellbore abandonment method in which cement remediation is performed in lieu of section milling.

In particular, FIG. 8-1 illustrates a downhole tool 800 after being tripped into a wellbore 862. The wellbore 862 may be cased or openhole (or have some cased and some openhole sections), although FIG. 8-1 illustrates a cased wellbore 862 with casing 864 installed therein. In some embodiments, an annular region of cement 863 may be positioned between the geological formation and the casing 864, and used to secure the casing 864 within the geological formation.

The downhole tool 800 that is tripped into the wellbore 862 may include various components, including a perforation tool 802 and/or a cement remediation tool 810 coupled to a bridge plug 840 by a connector 804. In the same or other embodiments, other running tools, including drill collars, transition drill pipe, circulation subs, section mills, jars, reamers, or other components may be included on, or coupled to, the downhole tool 800.

In addition to, or instead of, milling away a portion of the casing 864 to enable a well abandonment procedure to occur, the downhole tool 800 may perforate the casing 864. The perforation tool 802, for instance, may include one or more explosive charges. When the perforation tool 802 is positioned at a desired location in the wellbore 862, the explosive charges can be activated, thereby causing perforations 865 to be formed through the casing 864, cement 863, and into the geological formation.

By perforating the casing 864, fluids within the wellbore 862 may be able to contact the cement 863. In some embodiments, the cement 863 may have high permeability or may have degraded since installation. Some embodiments of the present disclosure may include one or more tools to facilitate remediating the cement and/or cleaning the annular region around the casing 864 where the cement 863 is located. With reference to FIG. 8-2, for instance, the downhole tool 800 has been moved from the position shown in FIG. 8-1 to align the cement remediation tool 810 with the perforations 865. When in the position shown in FIG. 8-2, the cement remediation tool 810 may be activated. Activation of the cement remediation tool 810 may allow fluid to flow through one or more ports 813 (as shown by the arrows in FIG. 8-2) and into the annular region within the casing 862, around the downhole tool 800. Optionally, one or more pack-off cups, swab cups, or other seals 811-1, 811-2 may be positioned above and below the perforations 865 to seal the annulus of the wellbore 862. As a result, fluid exiting the ports 813 may be restricted, and potentially prevented, from flow in the annulus above the seal 811-1 and below the seal 811-2. The fluid may instead flow into the perforations 865 and contact the cement 863. The fluid may degrade the cement 863 and potentially remove at least a portion of the cement around the casing 864. In some embodiments, the cement remediation tool 810 may act as a fluid by-pass or circulation tool. For instance, in one state, fluid may be allowed to flow past the ports 813, and upon activation fluid may instead (or also) flow through the ports 813. Further, in some embodiments, a bypass may be activated to allow fluid to flow from below the seal 811-2 to above the seal 811-1 during tripping in of the downhole tool 800.

During or after remediating the cement using the cement remediation tool 810, a separate bride plug 840 may be activated, as shown in FIG. 8-3. The bridge plug 840 may be mechanically or hydraulically activated, and activation may cause the bridge plug 840 to expand or otherwise engage and anchor itself within the casing 862. The bridge plug 840 may create a fluid seal that restricts and potentially prevents flow in the wellbore 862 flowing from below the bridge plug 840 to above the bridge plug 840 and/or flow of fluid in the wellbore 862 flowing from above the bridge plug 840 to below the bridge plug 840. In some embodiments, the bridge plug 840 could be set before using the cement remediation tool 810.

Once the bridge plug 840 is set, the connector 804 may be released. In FIG. 8-4, for instance, the connector 804 is shown has having been released from the perforation tool 802 (e.g., by shearing of a shear pin following dropping of a ball or dart). In other embodiments, however, the connector 804 may be released from the bridge plug 840. In still other embodiments, the connector 804 may instead be coupled to the cement remediation tool 810, a section mill, a lead mill, or some other component, and may be fully or partially released therefrom. In some embodiments, a hydraulic or other disconnect tool may be used, and one or more of the bridge plug 840, connector 804, cement remediation tool 810, or perforation tool 802, can be disconnected from the drill string or other run-in tool. When the connector 804 or other disconnect is released, the downhole tool 800 may be pulled upwardly within the wellbore 862. The downhole tool 800 may be removed from the wellbore 862 and a cementing string may be inserted to allow a cement plug to then be formed in the wellbore 862, on top of the bridge plug 840 and potentially around the connector 804 (or any portion of the connector 804 remaining with the bridge plug 840). Cement may also flow into the perforations 865 to allow the cement to directly engage the geological formation and form a rock-to-rock seal. In some embodiments, the cement may also flow into the annular region between the casing 764 and the geological formation (e.g., where cement 863 was previously located). Optionally, instead of tripping the downhole tool 800 out of the wellbore, the downhole tool 800 may flow cement into the wellbore 862. For instance, the downhole tool 800 may include one or more cementing outlet ports 815 (e.g., between the perforation tool 802 and the cement remediation tool 810, below the perforation tool 802, etc.). that allow cement to flow directly through at least a portion of the downhole tool 800 and into the wellbore 862 to allow the cement plug to be formed.

The method illustrated in FIGS. 8-1 to 8-4 is illustrative of one example method for abandoning a wellbore, but a person having ordinary skill in the art will appreciate that the method may be varied in any number of manners, including by using additional or different equipment. For instance, the cement remediation tool may be removed in some embodiments, or additional section milling, reaming, pipe cutting and pulling, or other operations may occur.

Figure 9:
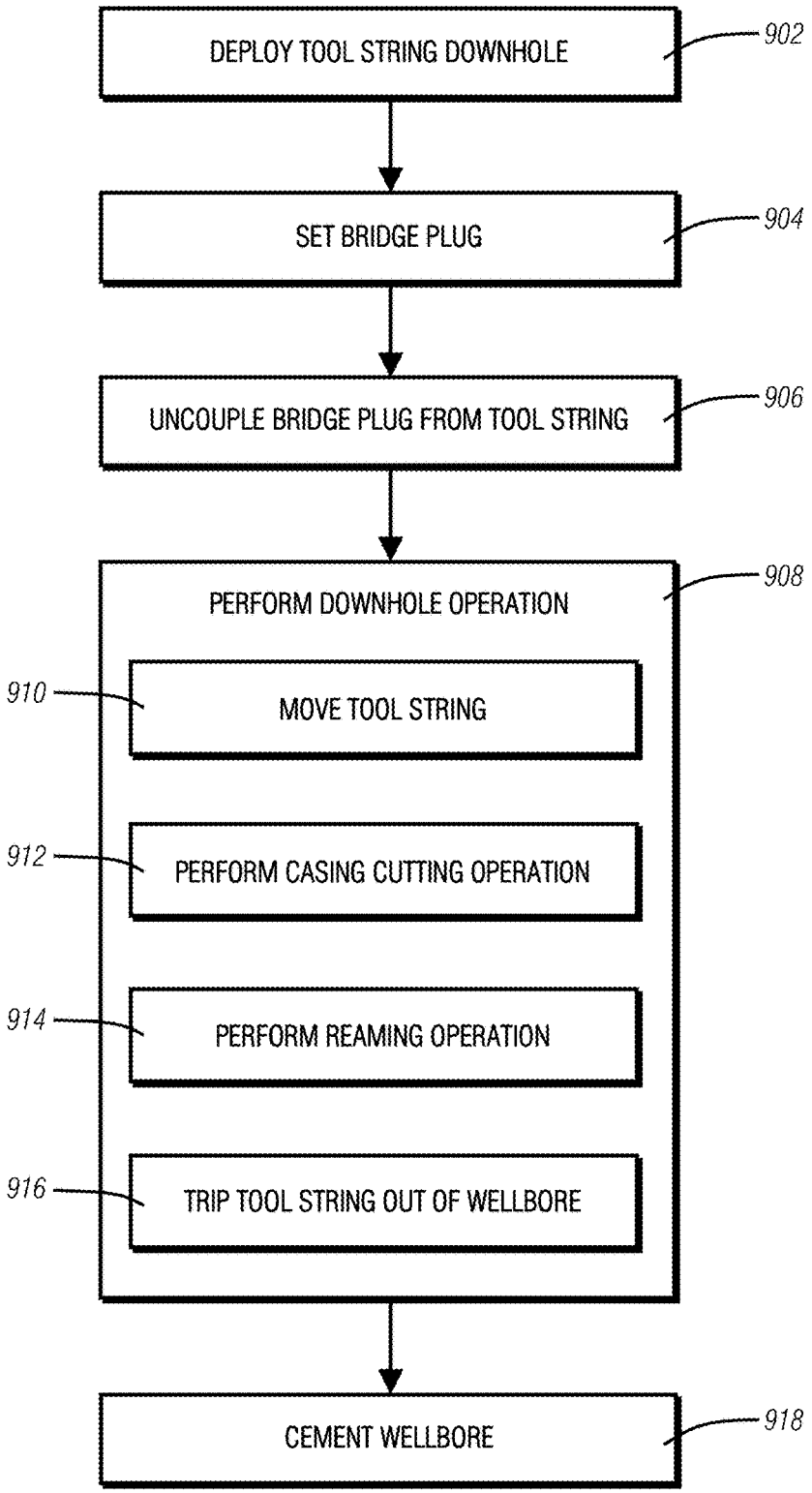
FIG. 9 is a flowchart for a method for abandoning a wellbore, according to an embodiment of the present disclosure.

Referring now to FIG. 9, a method 900 for setting a bridge plug and/or abandoning a wellbore is schematically illustrated. At 902, a tool string may be deployed downhole in a wellbore. In some embodiments, the tool string that is deployed downhole may include a downhole tool coupled to a bridge plug. In at least some embodiments, the tool string may include a section mill, a reamer, a lead mill, stabilizers, other components, or any combination of the foregoing. At 904, the bridge plug may be set at a desired depth in a geological formation. For instance, using mechanical, electrical, hydraulic, hydro-mechanical, RFID, other actuation mechanisms, or some combination of the foregoing, a packer or other bridge plug may be activated and set/anchored within the wellbore. The bridge plug may create a fluid seal that restricts or even prevents fluid flow between different zones of the wellbore.

At 906 the bridge plug may be uncoupled from the tool string. Uncoupling the tool string and bridge plug may include applying an axial and/or rotational force to break a pin or other shear element. In some embodiments, a connector used to couple the tool string to the bridge plug may remain coupled to the bridge plug, but may be disconnected from the tool string. In other embodiments, the connector may remain coupled to the tool string but may be disconnected from the bridge plug.

At 908, a downhole operation may be performed using the tool string. In at least some embodiments, the downhole operation may be performed in the same trip during which the bridge plug is set. Performing the downhole operation at 908 may include one or more different operations. For instance, performing a downhole operation at 908 may include moving the tool string at 910. The tool string may be moved to a position where the tool string is separated from the bridge plug. Such movement may include moving a section or lead mill toward the surface of the wellbore. In at least some embodiments, performing a downhole operation at 908 may include performing a casing cutting operation at 912. The casing cutting operation may occur after, before, or during moving the tool string at 910. For instance, a section mill may be moved, activated, and then moved again to mill and remove casing within an axial length of the wellbore. In another example, a perforation tool may cut the casing with one or more explosive charges. Optionally, a cement remediation operation may be performed as part of moving the tool string at 910 after perforating the casing at 912.

In some embodiments, performing a downhole operation at 908 may include performing a reaming operation at 914. The reaming operation may be used to widen the wellbore or to ensure that portion of the wellbore may be opened to have a rock-to-rock connection for a cementing operation. In some embodiments, performing a reaming operation at 914 may occur before, during, or after moving the tool string at 910 and/or performing the section milling operation at 912. As part of performing the downhole operation 908, the tool string may optionally be tripped out of the wellbore at 916. The wellbore may then be cemented at 918. Such cementing may form a cement plug on and/or above the bridge plug set at 904. In some embodiments, cementing of the wellbore at 918 may occur before, or without, tripping the tool string out of the wellbore at 916.

Figure 10:
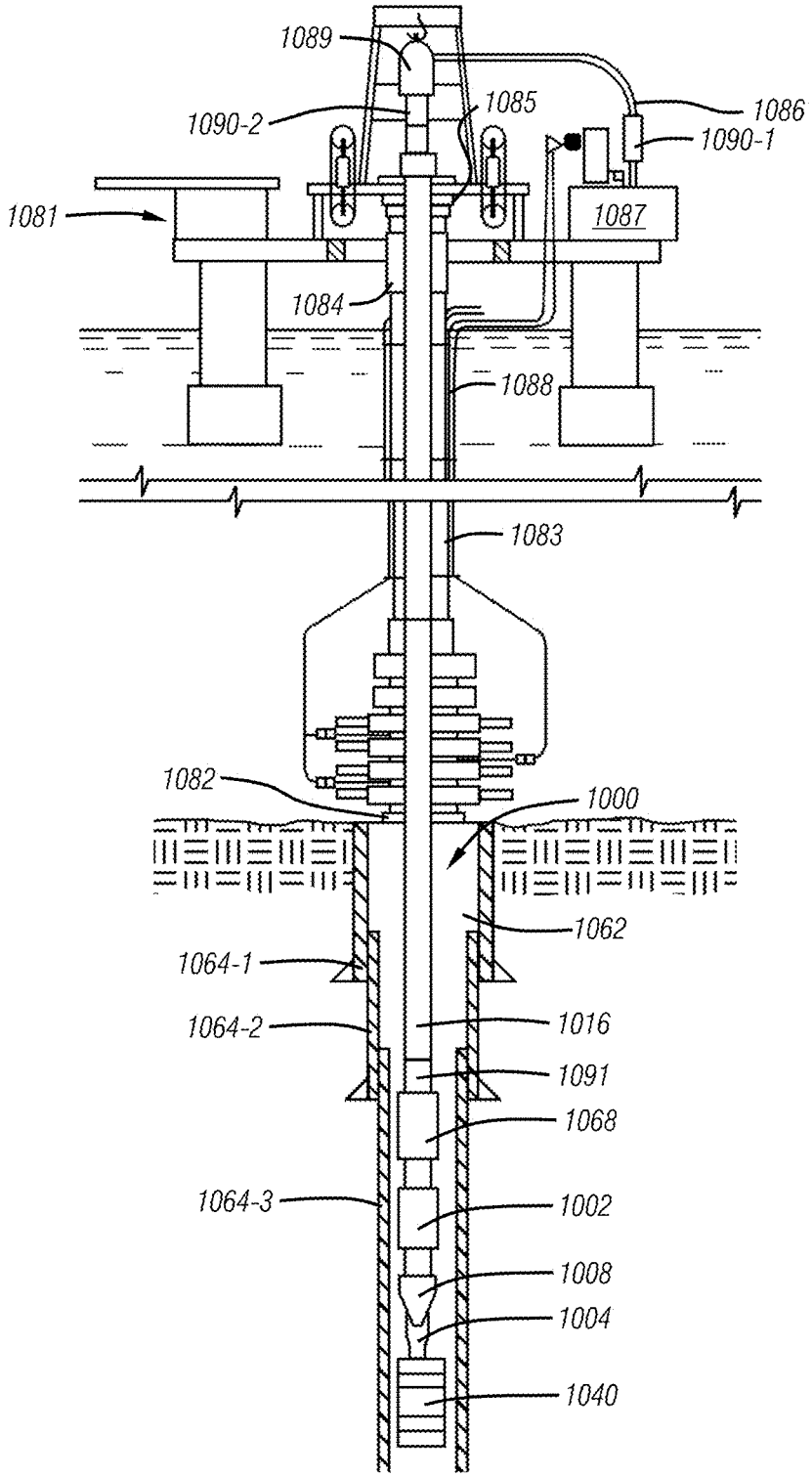
FIG. 10 is a partial cross-sectional view of an offshore environment for use of a downhole tool for installing a bridge plug and performing a section milling operation, according to an embodiment of the present disclosure.

Embodiments of the present disclosure may be used or performed in a variety of environments, including in land or offshore environments. FIG. 10, for instance, illustrates an example offshore environment for using a downhole tool 1000 according to embodiments of the present disclosure. In other embodiments, however, a land or other type of rig or environment may be used.

In the particular embodiment illustrated in FIG. 10, the offshore environment may be used in connection with a wellbore 1062 that may be an openhole/uncased wellbore, or a cased wellbore. In particular, the illustrated wellbore 1062 is a cased wellbore including one or more casing sections 1064-1, 1064-2, 1064-3 installed therein. The casing sections 1064-1, 1064-2, 1064-3 may include casing extending to the surface of the wellbore 1062, or may include liner hung within an upper casing section.

The offshore environment may include a platform, semi-submersible, floating structure, or other type of rig 1081 positioned above a wellhead 1082. A riser 1083 may be coupled to the wellhead 1082. To compensate for the relative longitudinal movement or heave between the rig 1081 and the riser 1083, any suitable mechanism may be used. In one embodiment, for instance, a telescopic joint 1084 may be used and coupled to the riser 1083 and the rig 1081. The same or other mechanisms may be used to compensate for horizontal, rotational, or other movement (e.g., pitch, roll, etc.) of the rig 1081 relative to the riser 1083. For instance, a ball joint 1085 may be used between the rig 1081 and the riser 1083. In some embodiments, the riser 1083 may be fixed and the rig 1081 may movable.

When performing a downhole operation with the downhole tool 1000, some embodiments contemplate the use of drilling fluid. In at least some embodiments, the drilling fluid may be provided to the interior of the downhole tool 1000 and may flow through the drill string 1016. In the same or other embodiments, drilling fluid may flow around the drill string 1016 (e.g., within the riser 1083, in a reverse-circulation system, etc.). Flow of drilling mud into the downhole tool 1000 or downhole system may be controlled using an output flow line 1086 in communication with a mud pit 1087.

The drilling fluid may be used for a variety of purposes in the downhole tool 1000. For instance, as discussed herein, the downhole tool 1000 may include a plug 1040, a connector 1004, a lead mill 1008, a casing cutting tool 1002 (e.g., a perforation tool, a pipe cutter, a section mill, etc.), a reamer 1068, an expandable stabilizer, a fixed stabilizer, a cement remediation tool, a jar, a vibration tool, other tools, or any combination of the foregoing. In some embodiments, the drilling fluid may actuate or be used with such tools. Drilling fluid may, for instance, provide hydraulic energy for activating the plug 1040 (e.g., packer, bridge plug, frac plug, etc.). The drilling fluid may also be jetted through nozzles in the lead mill 1008 or another bit, the casing cutting tool 1002, or the reamer 1068 to cool cutting elements thereon. The drilling fluid may also activate one or more of the components of the downhole tool 1000.

In at least some embodiments, the drilling fluid may be used to, among other things, carry cuttings to the surface. In the illustrated embodiment, cuttings in annulus of the wellbore 1062 may flow around the drill string 1016 and toward the surface. The fluid and cuttings may flow through the riser 1083 and through an inlet flow line 1088 into the mud pit 1087. In some embodiments, a shaker or other separator may receive the drilling fluid to separate the fluid from the cuttings prior to returning the drilling fluid to the mud pit 1087.

In operation, the drill string 1016 may be rotated by a top drive, rotary table, or other drive system 1089 on the rig 1081. The drill string 1016 transfers rotation from the drive system 1089 to the downhole tool 1000. When operation of the downhole tool 1000 begins, the drilling fluid supplied to the downhole tool 1000 may not be conditioned (e.g., due to use of new drilling fluid, a period of inactivity, etc.). Such drilling fluid may be more viscous and colder than conditioned drilling fluid. In some embodiments, conditioned drilling fluid facilitates efficient operation of the downhole tool 1000.

The drilling fluid may transition from an unconditioned to a conditioned state in any number of manners. For instance, the drilling fluid may be run through the downhole tool 1000 without operating the downhole tool 1000. This may cycle the drilling fluid through the system and cause the drilling fluid to heat up and otherwise become conditioned. In other embodiments, one or more conditioning tools 1090-1, 1090-2 may be used to condition the drilling fluid.

In particular, the conditioning tools 1090-1, 1090-2 may be placed between the mud pit 1087 and the drill string 1016 in order to accelerate conditioning of the drilling fluid, thereby reducing the cycle time for the drilling fluid. The conditioning tool 1090-1 may be located between the mud pit 1087 and the top drive 1089, in some embodiments. Optionally, the conditioning tool 1090-1 may be removable or be deactivated. For instance, once the drilling fluid becomes conditioned, the conditioning tool 1090-1 may be removed from a position between the mud pit 1087 and the drive system 1089. In other embodiments, the conditioning tool 1090-1 may have active/inactive states. In the inactive state, the conditioning tool 1090-1 may be passive and act as a flow-through device. As a result, when the drilling fluid becomes conditioned, the conditioning tool 1090-1 may be deactivated to stop conditioning the drilling fluid, but may continue to allow the drilling fluid to flow therethrough.

In some embodiments, the conditioning tool 1090-2 may be provided in addition to, or instead of, the conditioning tool 1090-1. The conditioning tool 1090-2 may be configured to condition drilling fluid prior to activating at least a portion of the downhole tool 1000 (e.g., a milling tool). The conditioning tool 1090-2 may, in some embodiments, be a tubular element that can be temporarily or permanently fixed to or above the drill string 1016 above the wellhead 1082 (and optionally above a rotary table, kelly, etc.). In the illustrated embodiment, for instance, the conditioning tool 1090-2 is coupled between the drive system 1089 and a proximal or uphole end of the drill string 1016.

The conditioning tool 1090-2 may take any number of forms. For instance, in one embodiment, the conditioning tool 1090-2 may be a pressure sub. An illustrative pressure sub may be a downhole tool used, for instance, below a reamer or other downhole tool to increase back pressure to cause cutter blocks, blades, or other expandable members to expand. The pressure sub may have an interior bore that necks down to a reduced cross-sectional area portion, or which includes a restriction of some sort. The restriction may restrict flow, thereby increasing pressure above the pressure sub. Example pressure subs of this sort have been in use by Smith International, Inc. since at least 2006. In some embodiments, the same pressure sub used in a downhole environment to create back pressure may be used as the conditioning tool 1090-2. In particular, the same pressure sub used in a downhole tool may be moved above the surface (or another pressure sub may be added) and coupled to the drive system 1089 and the uphole end of the drill string 1016. Once flow starts and the drilling fluid thins and becomes conditioned, the pressure sub or other conditioning tool 1090-2 may be removed and the drill string 1016 may be coupled directly to the drive system 1089, a saver sub, or other component coupled to the drive system 1089. A known tool (e.g., a pressure sub) may therefore be used for an additional purpose by moving it to a different location within the drilling system.

In other embodiments, the conditioning tool 1090-2 may not be removed, but may be deactivated. For instance, a restriction in the conditioning tool 1090-2 may be movable between an active or extended state, and an inactive or retracted state. In the active state, the restriction may cause the conditioning tool 1090-2 to operate and condition the drilling fluid. The restriction may, for instance, act as a nozzle forcing the drilling fluid to speed up through the conditioning tool 1090-2. The drilling fluid may exit the conditioning tool 1090-2 and enter a larger diameter bore and turbulent flow may shear the drilling fluid to cause conditioning thereof. A switch, latch, or the like may be coupled to the movable restriction. As a result, when the switch, latch, or the like is activated, the restriction may retract in the conditioning tool 1090-2, thereby increasing the diameter of the internal bore. The drilling fluid may thus no longer experience as large of fluid accelerations, and fluid shearing may be reduced. As a result, the conditioning tool 1090-2 may act as an in-line conditioning tool when in an active state, and as a flow-through or bypass tool when in an inactive state. By making the conditioning tool 1090-2 configurable, the conditioning tool 1090-2 may be deactivated without down time associated with removing the conditioning tool 1090-2 and re-coupling the drill string 1016 to the drive system 1089.

In some embodiments, a bypass sub 1091 may be used as part of the downhole tool 1000. Ports of the bypass sub 1091 may be open while conditioning the drilling fluid using one or more of the conditioning tools 1090-1, 1090-2. As a result, the drilling fluid may flow out of the bypass sub 1091 and into the annulus of the wellbore 1062 so as not to activate cutter blocks, blades, knives, plugs, or other components of the downhole tool 1000. When the drilling fluid is sufficiently heated, thinned, sheared, or otherwise conditioned, the ports of the bypass sub 1091 may be closed and the conditioning tools 1090-1, 1090-2 may be removed or deactivated. As a result, continued flow of drilling fluid may be used to activate the plug 1040, activate one or more knives or blades of the casing cutting tool 1002, initiate an explosive charge within the casing cutting tool 1002, activate one or more cutter blocks of the reamer 1068, or perform any other desired action within the downhole tool 1000.

Example methods for abandoning a wellbore, according to some embodiments of the present disclosure, include tripping a tool string and a bridge plug into a wellbore. The tool string may include any combination of a reamer, a section mill, a casing cutter, a pipe cutter, a perforation tool, or a cement remediation tool. The tool string may be releasably coupled to the bridge plug by a connector. The bridge plug may be set within the wellbore and the bridge plug may be uncoupled from the tool string (e.g., by uncoupling the connector from the tool string and/or the bridge plug). The tool string may be moved uphole relative to the bridge plug.

Casing cutting may occur prior to or after setting the bridge plug. For instance, a section mill may be activated before or after setting a bridge plug, and a section milling operation may be performed to form a section milled portion of a wellbore. A reamer may be activated before or after setting the bridge plug to perform a reaming operation to form a reamed portion of the wellbore. The reamed portion may be within a section milled portion of the wellbore. A perforating tool may be activated before or after setting the bridge plug to perforate casing using one or more explosive charges. A cement remediation tool may be activated to flow fluid into an annular region between casing and a geological formation. In some embodiments, the cement remediation tool may flow fluid through one or more perforations in the casing. Cement may be pumped into a wellbore, and the cement may form a plug on the bridge plug and provide rock-to-rock engagement with the geological formation. For instance, rock-to-rock engagement may be provided in a reamed portion of a wellbore, a perforated portion of the wellbore, or both. Optionally, the tool string may be tripped out of the wellbore while leaving the connector and bridge plug in the wellbore. In at least some embodiments, the bridge plug may be mechanically, hydraulically, or hydromechanically set. In the same or other embodiments, a tool string including a lead mill releasably coupled to the connector, the lead mill including a shoulder on an internal surface thereof, the shoulder being configured to mate with an upper surface of the connector to align one or more openings configured to receive a shear element.

Activating a tool or switching between tool states may be accomplished for the various tools and systems described herein, by using any number of different mechanisms. A piston, ball and ball seat, dart, or the like may be used to develop a pressure differential suitable for hydraulically activating a tool. For instance, by dropping a ball or dart, pressure may build which can cause a shear pin or other frangible element to break and allow a sleeve to move to open or close various fluid ports, thereby activating a tool or changing tool state. Multiple ball drops, dart activations, or the like may be performed. In other embodiments, mechanical, electrical, RFID, wireless, or other activation mechanisms may be used. Combinations of the foregoing may also be used to activate a tool or change tool state.

In the description herein, various relational terms are provided to facilitate an understanding of various aspects of some embodiments of the present disclosure. Relational terms such as "bottom," "below," "top," "above," "back," "front," "left," "right," "rear," "forward," "up," "down," "horizontal," "vertical," "clockwise," "counterclockwise," "upper," "lower," "uphole," "downhole," and the like, may be used to describe various components, including their operation and/or illustrated position relative to one or more other components. Relational terms do not indicate a particular orientation for each embodiment within the scope of the description or claims. For example, a component of a downhole tool or bottomhole assembly that is described as "below" another component may be further from the surface while within a vertical wellbore, but may have a different orientation during assembly, when removed from the wellbore, or in a deviated borehole. Accordingly, relational descriptions are intended solely for convenience in facilitating reference to various components, but such relational aspects may be reversed, flipped, rotated, moved in space, placed in a diagonal orientation or position, placed horizontally or vertically, or similarly modified. Certain descriptions or designations of components as "first," "second," "third," and the like may also be used to differentiate between identical components or between components which are similar in use, structure, or operation. Such language is not intended to limit a component to a singular designation. As such, a component referenced in the specification as the "first" component may be the same or different than a component that is referenced in the claims as a "first" component.

Furthermore, while the description or claims may refer to "an additional" or "other" element, feature, aspect, component, or the like, it does not preclude there being a single element, or more than one, of the additional or other element. Where the claims or description refer to "a" or "an" element, such reference is not be construed that there is just one of that element, but is instead to be inclusive of other components and understood as "at least one" of the element. It is to be understood that where the specification states that a component, feature, structure, function, or characteristic "may," "might," "can," or "could" be included, that particular component, feature, structure, or characteristic is provided in some embodiments, but is optional for other embodiments of the present disclosure. The terms "couple," "coupled," "connect," "connection," "connected," "in connection with," and "connecting" refer to "in direct connection with," or "in connection with via one or more intermediate elements or members." Components that are "integral" or "integrally" formed include components made from the same piece of material, or sets of materials, such as by being commonly molded or cast from the same material, or machined from the same one or more pieces of material stock. Components that are "integral" should also be understood to be "coupled" together.

Although various example embodiments have been described in detail herein, those skilled in the art will readily appreciate in view of the present disclosure that many modifications are possible in the example embodiments without materially departing from the present disclosure. Accordingly, any such modifications are intended to be included in the scope of this disclosure. Likewise, while the disclosure herein contains many specifics, these specifics should not be construed as limiting the scope of the disclosure or of any of the appended claims, but merely as providing information pertinent to one or more specific embodiments that may fall within the scope of the disclosure and the appended claims. Any described features from the various embodiments disclosed may be employed in any combination. Processes and components of a method may be performed in any order.

A person having ordinary skill in the art should realize in view of the present disclosure that equivalent constructions do not depart from the spirit and scope of the present disclosure, and that various changes, substitutions, and alterations may be made to embodiments disclosed herein without departing from the spirit and scope of the present disclosure. Equivalent constructions, including functional "means-plus-function" clauses are intended to cover the structures described herein as performing the recited function, including both structural equivalents that operate in the same manner, and equivalent structures that provide the same function. It is the express intention of the applicant not to invoke means-plus-function or other functional claiming for any claim except for those in which the words 'means for' appear together with an associated function. Each addition, deletion, and modification to the embodiments that falls within the meaning and scope of the claims is to be embraced by the claims.

While embodiments disclosed herein may be used in oil, gas, or other hydrocarbon exploration or production environments, such environments are merely illustrative. Systems, tools, assemblies, methods, bridge plug systems, milling systems, perforating systems, plugging systems, well abandonment systems, and other components of the present disclosure, or which would be appreciated in view of the disclosure herein, may be used in other applications and environments. In other embodiments, milling tools, perforating tools, bridge plugs, or other embodiments discussed herein, or which would be appreciated in view of the disclosure herein, may be used outside of a downhole environment, including in connection with other systems, including within automotive, aquatic, aerospace, hydroelectric, manufacturing, medical, other industries, or even in other downhole environments. The terms "well," "wellbore," "borehole," and the like are therefore also not intended to limit embodiments of the present disclosure to a particular industry. A wellbore or borehole may, for instance, be used for oil and gas production and exploration, water production and exploration, mining, utility line placement, or myriad other applications.

Certain embodiments and features may have been described using a set of numerical values that may provide lower and upper limits. It should be appreciated that ranges including the combination of any two values are contemplated unless otherwise indicated, and that a particular value may be defined by a range having the same lower and upper limit. Numbers, percentages, ratios, measurements, or other values stated herein are intended to include the stated value as well as other values that are about or approximately the stated value, as would be appreciated by one of ordinary skill in the art encompassed by embodiments of the present disclosure. A stated value should therefore be interpreted broadly enough to encompass values that are at least close enough to the stated value to perform a desired function or achieve a desired result. The stated values include at least experimental error and variations that would be expected by a person having ordinary skill in the art, as well as the variation to be expected in a suitable manufacturing or production process. A value that is about or approximately the stated value and is therefore encompassed by the stated value may further include values that are within 10%, within 5%, within 1%, within 0.1%, or within 0.01% of a stated value.

Embodiments are shown in the identified drawings. The drawings are to scale for some embodiments of the present disclosure, but are not to scale for other embodiments contemplated as within the scope of the present disclosure. The drawing should be usable to identify relative sizes and positioning of some embodiments, but such sizes and positioning may be exaggerated, understated, or schematic for other embodiments contemplated herein.

The abstract included with this disclosure is provided to allow the reader to quickly ascertain the general nature of some embodiments of the present disclosure. The abstract is submitted with the understanding that it will not be used to interpret or limit the scope or meaning of the claims.

What is claimed is:

1. A tool, comprising:

a casing cutting tool;

a bridge plug; and a tubular connector coupling the casing cutting tool to the bridge plug, at least a portion of the casing cutting tool being positioned within a bore of the tubular connector, the bore extending a full axial length of the tubular connector.

2. The tool of claim 1, the casing cutting tool including at least one of a lead mill, a section mill, a perforating tool, or a pipe cutter.

3. The tool of claim 1, further comprising:

a drill string coupled to the casing cutting tool and configured to convey the casing cutting tool, bridge plug, and tubular connector into a wellbore for single-trip setting of the bridge plug and cutting of a casing within the wellbore.

4. The tool of claim 1, the casing cutting tool including a lead mill, and the tubular connector being configured to couple to a face of the lead mill.

5. The tool of claim 1, further comprising:

at least one shear element coupling the tubular connector to the casing cutting tool.

6. The tool of claim 1, the tubular connector being configured to releasably couple the casing cutting tool to the bridge plug.

7. The tool of claim 1, the tubular connector defining one or more slots aligned with, and receiving therein, one or more blades of the casing cutting tool.

8. A downhole tool, comprising:

a casing cutting tool, the casing cutting tool including a section mill configured to cut casing while centered within the casing and a stabilizer configured to maintain the section mill centered within the casing; and a tubular connector releasably coupled to the casing cutting tool by a shear element, at least a portion of the casing cutting tool being positioned within a bore of the connector, the connector being configured to be coupled to a bridge plug, the connector including an activation mechanism for the bridge plug.

9. The downhole tool of claim 8, further comprising:

a bridge plug coupled to the tubular connector and configured to remain coupled to the tubular connector after breakage of the shear element.

10. The downhole tool of claim 8, wherein the stabilizer is a lead mill positioned between the section mill and the tubular connector.

11. The downhole tool of claim 8, the shear element being configured to support a weight of the downhole tool, and to break upon application of a rotational force.

12. The downhole tool of claim 8, wherein the activation mechanism is a mechanical activation mechanism.

13. The downhole tool of claim 8, wherein the bore of the tubular connector is in fluid communication with the bridge plug, the bridge plug configured to activate upon a fluid flow through the bore.

14. The downhole tool of claim 8, wherein the bore is parallel to a longitudinal axis of the tubular connector.

15. A method, comprising:

deploying a tool string downhole in a wellbore, the tool string including a casing cutting tool coupled to a mechanically set bridge plug by a tubular connector having a bore therethrough;

setting the bridge plug within the wellbore; and in a same trip during which the bridge plug is set within the wellbore, moving the tool string uphole of the tubular connector and removing at least some casing uphole of the tubular connector using the casing cutting tool, the tubular connector configured to releasably couple to the casing cutting tool by a shear element.

16. The method of claim 15, the casing cutting tool including a section mill, wherein removing at least some casing uphole of the tubular connector includes expanding blades of the section mill radially and maintaining the section mill centered within the wellbore.

17. The method of claim 15, wherein:

the casing cutting tool is a section mill, and removing at least some casing includes performing a section milling operation;

the casing cutting tool is a perforation tool, and removing at least some casing includes perforating the casing; or the tool string includes a cement remediation tool, and the method further includes remediating cement in a same trip during which the bridge plug is set within the wellbore and at least some casing is removed using the casing cutting tool.

18. The method of claim 15, the tool string further including a reamer, and the method further comprising:

in the same trip during which the bridge plug is set within the wellbore, conducting a reaming operation using the reamer.

19. The method of claim 18, the reaming operation being performed within a milled portion of the wellbore.

20. The method of claim 15, further comprising:

forming a cement plug aligned with a portion of the wellbore where the at least some casing is removed.

* * * * *